US006033150A

United States Patent [19]

Culen

[11] Patent Number: 6,033,150

[45] Date of Patent: Mar. 7, 2000

[54] METHOD FOR SUPPRESSING BORER ATTACK OF MARINE STRUCTURES AND AN IMPROVED, BORER-IMMUNE MARINE STRUCTURE

[76] Inventor: Matthew F. Culen, 1141 Clay Ave., Pelham, N.Y. 10803

[21] Appl. No.: 08/805,701

[22] Filed: Feb. 25, 1997

[51] Int. Cl.[7] ..... E02D 5/60

[52] U.S. Cl. ..... 405/216; 405/211; 52/169.9; 52/736.3; 52/736.4

[58] Field of Search ..... 405/216, 211; 52/169.2, 169.9, 170, 725, 730.7, 736.3, 736.4, 738.1; 138/99, 110, 120, DIG. 1, DIG. 7; 249/1

[56] References Cited

U.S. PATENT DOCUMENTS

| | | | |
|---|---|---|---|
| 968,798 | 8/1910 | Proper | 249/1 |
| 985,605 | 2/1911 | Konopinski | 52/736.4 X |
| 1,475,048 | 11/1923 | Campbell | 52/736.4 |
| 2,308,793 | 1/1943 | Upton | 405/216 |
| 3,103,103 | 9/1963 | Liddel | 405/216 |
| 3,321,924 | 5/1967 | Liddel | 405/216 |
| 4,083,588 | 4/1978 | Berger | 139/99 X |
| 4,244,156 | 1/1981 | Watts, Jr. | 405/216 X |
| 4,306,821 | 12/1981 | Moore | 405/216 |
| 4,439,071 | 3/1984 | Roper, Jr. | 405/216 |
| 4,892,410 | 1/1990 | Snow et al. | 405/216 X |
| 5,380,131 | 1/1995 | Crawford | 405/216 |
| 5,591,265 | 1/1997 | Tusch | 405/216 X |

FOREIGN PATENT DOCUMENTS

| | | | |
|---|---|---|---|
| 71217 | 2/1983 | European Pat. Off. | 405/216 |

*Primary Examiner*—David Bagnell
*Assistant Examiner*—Jong-Suk Lee
*Attorney, Agent, or Firm*—Paul C. Scifo

[57] ABSTRACT

Method for suppressing borer attack and accompanying erosion in a marine structure such as a pier or dock, and a borer-immune structure resulting from application of the method. The method features steps for encasing the exposed surfaces of a wooden marine structure with a plurality of rigid plates sized to the surfaces to be encased. Steps are provided for supplying a water-resistant sealant at predetermined regions on the plates such that the sealant may be spread over predetermined portions of the structure surface and the plates by clamping the plates and sealant to the marine structure with a corrosive resistant fastener. The method also preferably includes steps for providing the encasing plates with sealant-locating furrows at the plate faces that mate with the marine structure to be encased, the locating furrows being provided for receiving the sealant at a prescribed location relative to plate borders and for pre-measuring the amount of sealant to be applied. The borer-immune structure features a plurality of rigid, pre-sized encasing plates clamped to the surface of an underlying wooden marine structure by means of corrosive-resistant fasteners, the encasing plates and marine structure surface further including a layer of water-resistant sealant spread there between at predetermined locations of the plates and surface proximate the plate borders by clamping. Additionally the encasing plates preferably include furrows for receiving and pre-measuring the sealant to be applied.

18 Claims, 9 Drawing Sheets

METHOD FOR SUPPRESSING BORER ATTACK OF MARINE STRUCTURES AND AN IMPROVED, BORER-IMMUNE MARINE STRUCTURE

FIELD OF INVENTION

This invention concerns a method for suppressing the attack of wooden, marine structures by borers such as gribbles and shipworms, and an improved marine structure immune to borer attack; more particularly, the method features steps for sizing a plurality of encasing plates to the marine structure under attack; preparing a sealant; disposing the sealant at predetermined regions of the plates; positioning the plates and sealant on the marine structure; and spreading the sealant over predetermined portions of the structure and plates by clamping the sealant, plates and marine structure together to seal the structure; the improved, borer-immune structure features a sealant provided at predetermined portions of the wooden members which define the structure; encasing plates disposed over the sealant and wooden members; and fasteners that clamp the plates and sealant to the wooden members of the improved structure.

BACKGROUND OF INVENTION

Marine borers, particularly, gribbles, and shipworm, have been a scourge on wooden, maritime structures for centuries. Whether pier, dock or hull, given enough time, gribbles and shipworms will literally eat them alive. It was recently estimated that marine borers are causing more that $500 million in damage a year to U.S. waterfronts. In New York City alone, local government is spending in excess of $30 million over a two-year period to address the damage found in lower New York Harbor caused by increased borer activity—one of the negative side effects of cleaner water resulting from environmental improvement programs.

Gribbles, are marine isopod crustaceans; i.e., shrimp-like creatures, that are members of the biological family Limnoria. Typically they are about 5 mm (0.2 in) long, and live on submerged wood; for example, piers, bridge piles, and ship hulls. Gribbles destroy the structures they infest by burrowing at close intervals into the members that make up the structure and consuming the wood from which they are made. Gribbles digest the wood with the help of an intestinal enzyme that breaks down cellulose, the chief constituent of the wood cell walls.

Shipworms, on the other hand, are of the Teredo family, and are marine, bivalve mollusks. However, like gribbles, shipworms, also have a reputation for causing substantial damage to wooden marine structures such as boat bottoms, piers and bridge piles. As their name implies, shipworms have wormlike bodies and feature disproportionately large siphons. While typically on the order of 10 inches in length or less, shipworm have been known to grow to as much as 2 feet or more in length and have diameters of half an inch. The shell valves of shipworms take the form of two small anterior members with file-like ribs, which are specialized for boring. By means of alternating contractions of the muscles that actuate the valves, the file-like ribs produce a cutting action that enable shipworms to bore into the wood they infest. Thereafter, they consume the structure by digesting the cellulose of the wooden members that make up the structure.

Over time, two principal approaches have emerged for dealing with marine borers. One has been to attempt to poison bores that seek to infest marine structures by impregnating the structure's wooden members prior to fabrication with pesticidally effective chemical agents. Chemical agents reported effective against gibbles and shipworms include: water-soluble alkali arsenates such as ammonia, sodium and potassium arsenite alone or as further compounded with copper or copper and zinc. Additionally, mixtures of copper naohthenate and Cellosolve together with crystal violate, malachite green oxalate or tributyltin oxide have been reported as effective. Still further, yet others have noted that such additives as dibutylbenzylphenol and chlorothalnil, in suitable amounts can be effective as well as the old standby creosote with coal tar.

The use of poisonous, chemical agents, however, is of limited effectiveness and has associated negative side effects. First, impregnating marine timbers and piles is a costly and cumbersome process. Because of the size of the timbers and piles, not only are there large volumes of wood to be treated which require large amounts of chemical agent be used, but additionally, because of their size, the timbers and piles are difficult and expensive to handle for purposes of impregnation. As a result, impregnation, typically, can not be economically carried out once a structures has been built and is in place. Additionally, if used, additive agents are susceptible to being leached from the wooden members by the washing action of the tidal zone. As a result, the agents tend to have a limited effective life. Accordingly, impregnation, typically, is not a viable approach for resolving borer infestation problems once they arise. Still further, the use of chemical agents has the very negative side effect of putting toxic materials into the Nations waterways—a result inconsistent with today's objectives for ecological conservation.

As a second approach to avoiding the effects of marine bore attack, workers seeking to control them have found they can be killed by suffocation. Specifically, biologists have noted that gribbles and shipworms rely on contact with sea water to get the oxygen they require for survival. Accordingly, marine engineers have proposed and devised a number of schemes of varying effectiveness for interrupting the supply of sea water to the structural members bores infest. And, where seal is effected the result is not only are borers suffocated and killed, but also, a barrier is established which prevents return of the creatures for as long as the seal can be maintained.

Regrettably, however, though a variety of schemes have been proposed for suffocating marine borers, still problems remain. For example, some engineers have proposed wrapping marine structural members with plastic sheeting, while others have suggested the application of split tubing, and still others, jacketing and subsequent filling with mud, cement or epoxy. However, each of these approaches, requires the marine member be "uninterrupted" along the length to be protected, so that the covering which is typically put on in overlapping fashion, can be applied and sealed. While these approaches can be effective when used on piles having continuous, water-exposed surfaces; that is, surfaces which are not interrupted by the other structural members such as planking or reinforcing elements, from the mud line to the high-water line, they do not work well where the surface is interrupted; as for example, on the timbers that form the pile caps of piers and docks, and interrupted piles, such as those positioned next to walls or other structures. In the case of pile-cap timbers, the timber surfaces are interrupted both at their lower faces by the piles upon which the cap timbers rest and at their upper faces by the decking or planking of the pier or dock they support. As a result it is not possible to effectively wrap them.

Still further the noted approaches have yet other drawbacks specific to the particular, respective scheme. With regard to pile wraps, a representative illustration is presented in U.S. Pat. No. 5,516,236 issued to Williams et al. As described in the Williams et al. patent, plastic sheeting such as polyethylene, is wrapped around the circumference of a pile in overlapping fashion, at least at the longitudinal end, and mechanically sealed to the pile with neoprene strips, nails and/or straps. Though the wrap can be effective in keeping water from the covered portion of the pile, in addition to requiring the surface wrapped be uninterrupted, the integrity of plastic sheeting and mechanical seals have been found susceptible to damage from objects in the water; for example, floating debris such as drift wood, bottles and the like which may be driven against the covered piles by wave action and winds. As well, because of their light weight, wraps are subject to damage from boats that may moor to the protected dock and pier piles—and also from plain vandalism. Additionally, because of nonuniform pile diameter over pile length arising from natural run out or erosion, folds and wrinkles, typically, arise in the wrap either when first applied or over time which are susceptible to cracking and rupture from continuous wave action. Yet further, pile wraps because of their light-weight character offer little in the way of reinforcement for pile strength that have been significantly eroded as a result of borer action.

As an alternative to plastic wraps and their light gauge, it has been proposed that higher-weight, split tubing be used. As described in U.S. Pat. No. 4,697,957 issued to E. D. Hellmers, to overcome some of the difficulties associated with light-gauge, plastic sheeting such as ease of damaging and wrinkling, it has been proposed that a longitudinally split length of heaver gauge, extruded hexene-ethylene tubing be applied to the pile. As described by Hellmers, the tubing is selected to have a diameter slightly larger than the pile, so that longitudinal split tubing can be overlapped at its split longitudinal ends and nailed in place. Additionally, Hellmers proposes that the split ends be pulled tightly; as for example with nylon webbing encircling the tube to effect seal. As noted, however, because of its cylindrical character tubing is not suitable for interrupted marine members such as pile caps. Additionally, because of the less resilient nature of the tubing material, creation of an effective seal can be difficult. And, the ability to get effective overlap and seal is rendered more problematic where the diameter of the pile varies over its length as a result of either natural run out or erosion. Still further, once again, though of heaver weight, split tubing also affords only a limited capacity to rehabilitate borer eroded piles.

Continuing, while the previously described designs require the marine member to be protected be unobstructed, an approach has been proposed that would be applicable to obstructed marine members having generally flat surfaces as might be found on pile caps and the like. However, because of its makeup, a number of the shortcomings noted in connection with the previously described approaches are again present. Particularly, U.S. Pat. No. 3,870,009 issued to Liddell, describes a protective covering recommended for use on submerged marine structures such as barges pontoons, piers, and bulkheads. As proposed by Liddell, the covering features waterproof flat sheeting of plastic, synthetic fabric or thin metal, and a network of battens that form a lattice of individually sealed modules for protecting the structure form borer attack. As described, in preferred form, synthetic material such as polyvinyl chloride, polyethylene or polyurethane is flatly extended in either single or multiple modular unit sheets over the surface to be protected, and fastened at unit boarders in sandwich fashion between an underlying sealing strip of neoprene, rubber of the like, and an overlying, lattice strip or batten of wood, metal or synthetic material with corrosive resistant nails.

Regrettably, however, as in the case of pile wraps, because of the thinness of the sheeting material, the structure is susceptible to damage from floating marine debris, wave and wind action, marine navigation and vandalism. Additionally, the seal for the sheeting is also vulnerable to damage. Because the seal structure requires use of an underlying strip, a waterproof sheet, and a batten seal sandwich, the seal regions of the assembly project substantially away form the surface it is mounted to, rendering it open to damage from floating marine debris, marine navigation and vandalism. Finally, and again as in the case of pile wraps, the structure offers little in the way of rehabilitation for borer deteriorated structures.

While the approaches of pile wraps, split tubing and plane sheeting are lacking in facility for rehabilitating eroded piles and capacity to withstand physical abuse, the noted approach of jacketing is substantially more effective in those areas. Regrettably, however, though jacketing provides improved durability and capacity for rehabilitation, it does so at a substantial increase in cost and complexity, and while still requiring the surface to be protected be uninterrupted. An example of pile jacketing is provided in U.S. Pat. No. 4,306,821 issued to Moore. In accordance with the Moor approach, a flexible, plastic or fiber glass rectangular sheet is positioned about and spaced from a pile by rubber or the like upper and lower seals, the sheet being nailed to the seals and underlying pile. A tongue-and-grove end coupling enables the longitudinal ends of the sheet to be joined, so as to close the cylinder. As proposed by Moore, the upper seal is circumferential discontinuous so that a heaver-than-water, liquid epoxy or other suitable filler can be poured into the cylindrical form to displace the water and fill the portions of the pile eaten away by borers. Following the setup of the filler the jacketing can be optionally removed. Also, in accord with the Moore teaching, prior to application of the jacket, the borer eroded pile must be properly prepared to assure the filler will adhere to the pile. For this purpose, Moore requires the eroded pile be sand blasted to clean off debris and foreign matter so that the heaver-than-water filer can adhere and remain in place once the filler hardens.

As noted, though jacketing provides for more effective rehabilitation of eroded piles, the required elaborate cleaning of the pile surface, the positioning of the form, and the specialty filler make for a more complex, time consuming and expensive process to perform and structure to build. Yet further, where adherence of the filler to the pile is either not effected, or subsequently disrupted, water communication and associated bore activity may continue. And, as pointed out, because of the need for unobstructed surface, jacketing is not convenient for use on pile cap timbers.

SUMMARY OF INVENTION

Accordingly, it is an objective of the present invention to provide a method for suppressing borer attack of marine structures.

It is also an objective of the present invention to provide a borer-immune marine structure.

It is yet another objective of the present invention to provide a method for suppressing marine borer attach and a borer-immune marine structure that are capable of depriving borers of oxygen.

Still further it is an objective of the present invention to provide a method for suppressing borer attack and a borer-immune structure that are economical, cost effective and easy to practice.

Yet further it is an objective of the present invention to provide a method for suppressing borer attack and a borer-immune structure that are resistant to damage from floating debris, wave action and wind.

Yet additionally, it is an objective of the present invention to provide a method for suppressing borer attack and a borer-immune structure that are resistant to deterioration from the action of marine crafts and vandals.

Still additionally, it is an objective of the present invention to provide a method for suppressing borer attack and a borer-immune structure that are capable of improving the strength of marine structures that have been eroded by borer attack.

And, yet further, it is an objective of the present invention to provide a method for suppressing borer attack and a borer-immune structure that are capable of being used with marine pile caps, and interrupted or uninterrupted piles.

Briefly, the method for suppressing borer attack and the borer-immune structure in accordance with the present invention achieves the above and other objectives by including steps for encasing the exposed surfaces of the marine structure under attack with a plurality of plates sized to the surfaces to be encased, the plates having a water-resistant sealant distributed at predetermined regions on the plates such that the sealant may be spread over predetermined portions of the marine structure surface and the plates by clamping the plates and sealant to the marine structure with a corrosive resistant fastener.

In preferred form the method aspect of the invention features steps for making the encasing plates from synthetic material; such as, plastic wood, having a thickness sufficient to render the plates rigid. Additionally, the method includes steps for providing the plates with mounting holes for receiving fasteners of a prescribed size, located at predetermined intervals on the plates. Further, the method, in preferred form features steps for measuring the surface of the marine member to be enclosed and sizing one or more encasing plates to entirely cover the subject surface. Thereafter, the method features steps for applying a waterproof sealant, such as marine epoxy, at predetermined portions of the plates, specifically, spaced a prescribed distance from the plate borders. Subsequently, the method preferably includes steps for manually positioning the plates at the marine surface to be encased, and steps for inserting fasteners into the plates and marine surface. Thereafter, the method features steps for variably tightening the fasteners so as to controllably clamp the plates and epoxy to the marine surface and spread the epoxy into the marine surface and out to the boarders of the respective plates to seal the member surface.

Also in preferred from, the method features steps for providing the encasing plates with sealant locating means at the plate faces that mate with the marine structure to be encased, the locating means for receiving the sealant at a prescribed location relative to plate borders. Still further in preferred form, the method includes steps for configuring the sealant locating means so that it additionally pre-measures the sealant to be applied. Yet further in preferred form, the sealant-locating and pre-measuring means is formed as patterned depressions in the encasing plate face intended to mate with the marine structure to be encased.

In its article aspect, the invention features a borer-immune marine structure having a plurality of rigid, pre-sized synthetic encasing plates clamped to the surface of an underline wooden marine structure by means of corrosive-resistant fasteners, the encasing plates and marine structure surface further including a layer of sealing, marine epoxy spread there between at predetermined locations of the plates and surface proximate the plate boarders by clamping.

Still further, in preferred form, the encasing plates include means in the form of patterned depressions for receiving and pre-measuring the marine epoxy to be applied at predetermined locations on the plate face that mates with the wooden structure to be encased.

DESCRIPTION OF FIGURES

The above and other objectives, features and advantages of this invention will become apparent upon reading the following detailed description with reference to the accompanying drawings in which.

DESCRIPTION OF THE PREFERRED EMBODIMENT

Figure 1:
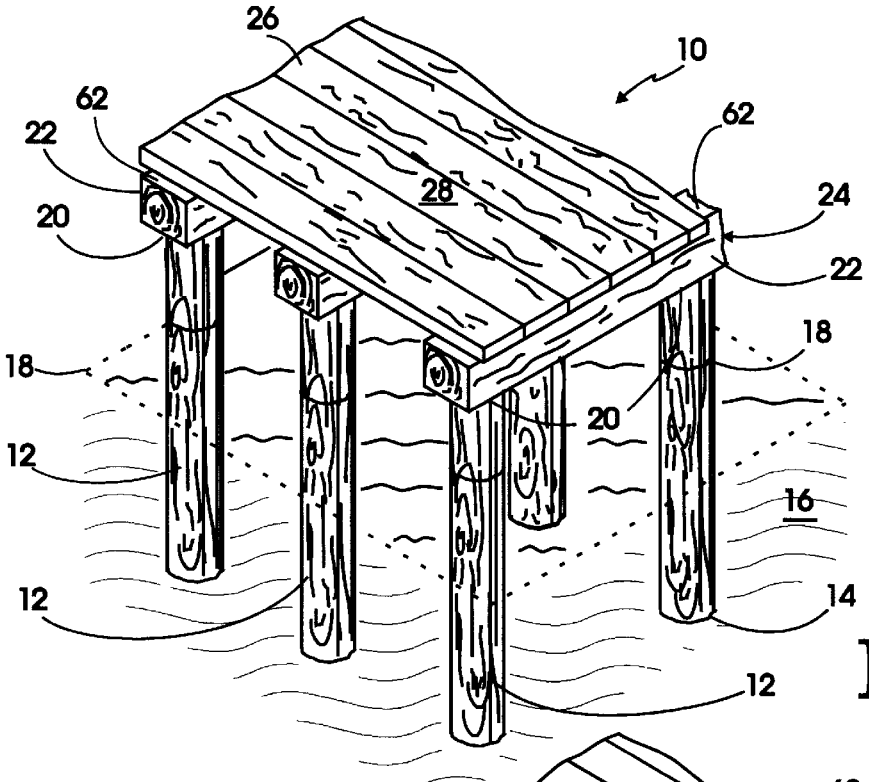
FIG. 1 is a perspective assembly view of a marine pier structure before attack by marine bores.

As described, marine borers are inflicting serious damage to America's waterfronts. Gribbles, and shipworms are estimated to cause in excess of $500 million a year in injury to U.S. piers, wharfs and bridge piles alone. While at least two principal forms of defense have been advanced to meet this attack, to date, the implementations have experienced substantial shortcomings.

The first approach, impregnation with pesticidal chemical agents, as noted, suffers from a number of problems. Particularly, impregnation has limited application, is high in cost, and, its agents dissipate over time and contribute to environmental pollution.

While pesticidal, chemical agents can be effective in suppressing borer action when used in sufficient quantity, the impregnation process is inefficient and difficult to use once the marine structure is erected. Further, impregnation offers absolutely no rehabilitative benefit to marine members already eroded. Accordingly, the procedure is not the approach of choice for installed structures. Also, where impregnation can be practiced, the cost is high due to the amount of material required to be applied and the difficulty in handling the typically large members to be treated. Still further, because marine structures are exposed to wave action, the impregnant is subject to leaching and associated dissipation over time. And, because the pesticidal agents are poisons, as they are leached into the waters surrounding the structures, they contribute to environmental degradation.

The second principal approach to marine borer control is suffocation. As also noted, marine biologists have found that gribbles and shipworms need contact with sea water to get the oxygen they require to sustain life. Accordingly, a number of schemes of varying effectiveness have been proposed for interrupting the supply of sea water to the structural members bores infest. The result is where seal can be established, not only are borers suffocated and die, but also, a barrier is established that suppresses return of the creatures for as long as the seal can be maintained.

However, as explained, though a variety of approaches have been proposed, problems remain. For example, some marine engineers have recommended wrapping marine structural members with plastic sheeting, while others have suggested the application of split tubing, and still others, jacketing and subsequent filling with mud, cement or epoxy. Each of these approaches, however, requires, that the marine member be "uninterrupted" along its length so that the covering which is typically put on in overlapping fashion, can be applied and sealed. Accordingly, while these approaches can be effective when used on piles having continuous, water-exposed surfaces; that is, surfaces from the mud line to the high-water line which are not interrupted by the other structural members such as planking or reinforcing elements, they do not work well where the surface is interrupted; as for example, on the timbers that form the pile caps of piers and docks, and obstructed piles.

Additionally, the various oxygen-depravation approaches developed to date have evidenced yet other drawbacks specific to the particular scheme proposed. For example, plastic pile wraps and their associated seals, in addition to requiring the surface to be wrapped be uninterrupted, exhibits susceptibility to damage from objects in the water such as floating debris like drift wood, bottles, etc, that may be driven against the covered piles by wave action and winds. Also, because of their light weight, wraps are subject to damage from boats that may moor to protected structures, and from simple vandalism. Yet further, because of the non-uniformity of pile diameter over the pile length arising from either natural-growth run out or erosion, folds and wrinkles typically arise in the wrap either when first applied or over time which are susceptible to cracking and rupture from continuous wave action. And, because of their light weight, pile wraps, like pesticides, offer little in the way of reinforcement for piles eroded as a result of borer action.

While higher-weight, split tubing has been proposed as an alterative to wraps, here too significant shortcomings have been found. Specifically, because of its cylindrical character, tubing is, again, not suitable for interrupted marine members such as pile caps. Additionally, because of the less resilient nature of the tubing material, creation of an effective seal can be problematic. And, the ability to get effective overlap and seal is made yet more difficult where pile diameter varies over its length due to either natural run out or erosion. Still further, once again, though of heaver weight, split tubing also affords only a limited capacity to rehabilitate borer eroded piles.

As also noted, though planar protective covering has been proposed for obstructed marine members having generally flat surfaces such as might be found on pile caps and the like, because of its makeup, a number of the shortcomings described in connection with the previously outlined approaches are again present. Particularly, planar protective covering proposed to date requires that a waterproof flat sheeting of plastic, synthetic fabric or thin metal, be mounted with a network of battens that form a lattice of individually sealed modules to the surface to be protected. As described, the synthetic sheeting extended in either single or multiple modular unit sheets over the surface to be protected, and is fastened at unit boarders in sandwich fashion between an underlying sealing strip of neoprene, rubber or the like, and an overlying, lattice strip or batten of wood, metal or synthetic material with corrosive resistant nails.

As in the case of pile wraps, because of the thinness of the sheeting material, the structure is susceptible to damage from floating marine debris, wave and wind action, marine navigation and vandalism. Additionally, by virtue of the use of an underlying strip, waterproof sheet, and batten seal sandwich, the seal regions of the assembly project substantially away form the surface it is mounted to, thus also exposing the seal structure to damage from floating marine debris, marine navigation and vandalism. Finally, and again as in the case of pile wraps, the structure offers little in the way of rehabilitation for borer deteriorated structures.

While the approaches of pile wraps, split tubing and plane sheeting are lacking in facility for rehabilitating eroded piles and capacity to withstand physical abuse, the noted approach of jacketing is substantially more effective in that area. Regrettably, however, though jacketing provides improved durability and capacity for rehabilitation, it does so at a substantial increase in cost and complexity, and while still requiring the surface to be protected be uninterrupted. In accordance with the typical approach, a rectangular sheet of plastic, fiberglass or the like is positioned coaxially about and spaced from a pile with upper and lower rubber type seals, the sheet being fastened to the seals and underlying pile using; for example, corrosive-resistant nails. A tongue-and-grove or overlapping end coupling enables the longitudinal ends of the sheet to be joined, so as to close the cylinder. A heaver-than-water filler such as liquid epoxy, cement, etc. can then be poured or pumped into the cylindrical form to displace the water and fill the portions of the pile eaten away by borers. Following the setup of the filler the jacketing may be optionally removed. In the common application, however, the borer eroded pile must be properly prepared to assure the filler will adhere to the pile. Specifically, it has been proposed that the eroded pile be sand blasted to clean off debris and foreign matter.

As noted, though jacketing provides for more effective rehabilitation of eroded piles, the required elaborate cleaning of the pile surface, the positioning of the form, and the specialty filler make for a more complex, time consuming and expensive process to perform and structure build. Yet further, where filler cover of the pile is either not effected or subsequently disrupted; as for example, by cracking or separation, water communication and associated bore attack may continue.

The present invention, however, overcomes the noted disadvantages of the prior approaches and includes a method and resulting improved marine structure that feature an effective, durable, water-tight seal that suppresses borer attach and further, contributes to rehabilitation of the eroded structural members.

FIG. 1 depicts a conventional marine structure, particularly, a pier designated 10, as it might appear before infestation and erosion by marine borers. For purposes of illustration, pier 10 is shown fragmented, and in typical fashion, is seen to include an array of pile members 12 that extend substantially vertically from a distance below the mud line 14 of a water body bed 16 to a uniform height above the highwater line 18. As seen in FIG. 1, at tops 20 of pile members 12, pile cap members 22 are laid across the piles to form pile caps 24 and define pile rows. Customarily, pile cap members 22 are fastened to pile tops 20 with spikes, lag bolts or the like, which, for the sake of simplicity, are not shown. Still further, again in typical fashion, planks 26 are laid across cap timber upper sides 62 to form a pier deck 28.

In practice, the pier members are made of wood, and typically, would be sized such that pile members 12 have nominal 12 inch diameters, which actually measure approximately 11.5 inches. Further, pile members 12 usually have a length of approximately 30 feet, and depending on the installation requirements for the site, a ratio of above-mud-line length to below-mud-line length of approximately 2 to 1. Likewise, pile cap members 22 are wooden and have a square cross section commonly sized to be compatible with pile members 12; for example, nominal 12 inch-wide sides that actually measure approximately 11.5 inches. Lengths, for pile cap members 22, again, are dictated by the site requirements, but, commonly are on the order of approximately 8 feet. Deck planks 26, yet again, would be typically made of wood, and be nominally sized as pieces having 2 by 8 inch cross sections and 10 foot lengths, planks 26 actually measure approximately 1.75 inches by 7.5 inches in cross section.

Figure 2:
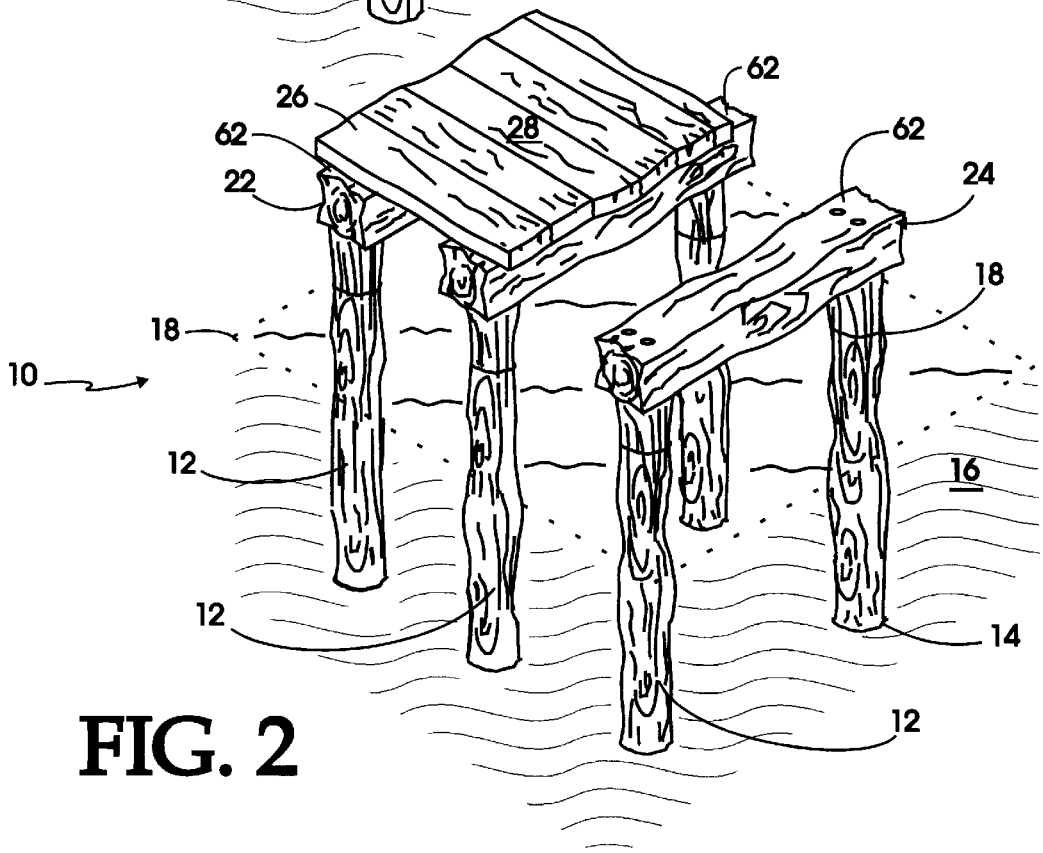
FIG. 2 is a broken-away, perspective assembly view of a marine pier structure showing erosion as a result of marine borer attack.

Pier 10, though substantial in form, and, costing typically tens of thousands of dollars to erect, can be, however, consumed, in as short a time as 5 years when attacked by gribbles and shipworms. As depicted in FIG. 2, pile members 12 are shown eroded by as much as 50 percent, the deterioration being most pronounced over the pile length having greatest water exposure; for example from the mud line 14 to high water mark 18. However, even above highwater mark 18, substantial damage may be evidenced in the tidal splash zone that would include pile caps 24. For purposes of illustration, a pile row and cap have been shown with deck 28 broken away to reveal the extent of deterioration to cap member 22, the damage being concentrated on the exposed side, ends, and bottom surfaces of the cap below deck 28. As will be appreciated, though as shown the amount of borer damage is substantial, producing an unsafe and potentially unusable structure, it is by no means final. In deed, if left unchecked, in time, continued borer attack would eventually eat away the structure to the point of collapse, presenting not only loss of the structures, but also a hazard to marine navigation.

Application of the present invention, however, has been found to not only suppress borer attack, but also, to contribute to restoration of the deteriorated structures. In accordance with the teaching of the present invention, this is accomplished by encasing the exposed surfaces of the attacked and eroded structure with a plurality of plates. Specifically, the plates are sized to the surfaces to be encased, and provided with a water-resistant sealant distributed at predetermined plate regions such that the sealant may be spread over portions of the structure surface and the plates by clamping the plates and sealant to the marine structure with corrosive-resistant fasteners. Once in place, the plates and sealant effectively seal off the surfaces encased, preventing any water from reaching the surfaces, with the effect that any borers infesting the structure are deprived of the oxygen they require to sustain life, and die. Additionally, once in place, the plates additionally serve to reinforce the erode marine members.

Figure 3:
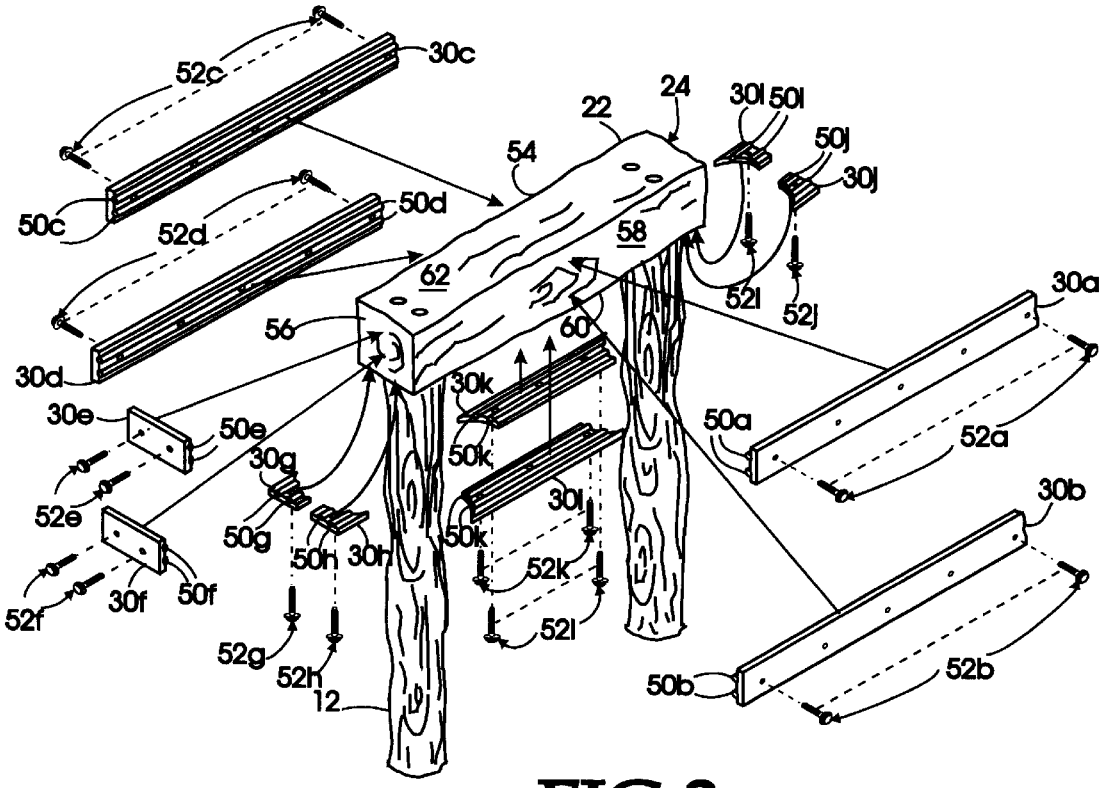
FIG. 3 is an exploded perspective view of a marine pile and cap structure relative to the timber-cap, encapsulating plates, sealant and fasteners of the present invention.
Figure 4:
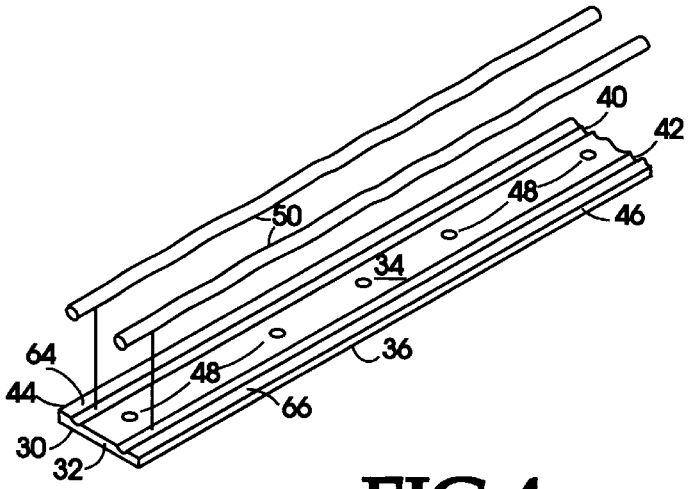
FIG. 4 is a perspective plan view of an encapsulating plate adapted for use on a pile cap timber and sealant in accordance with the invention.

FIG. 3 illustrates the method aspect of the invention as applied to pile cap 24 and particularly, pile cap member 22. As shown there, the method in accordance with the invention includes steps for sizing a series of plates 30*a*–30*l* to the exposed and deteriorated surfaces to be encased, and anchoring the plates together with a sealant 50*a* disposed at predetermined portions of the plates to cap member 22 with fasteners 52*a*. In accordance with the invention, each of plates 30*a*–30*l* are substantially the same unless otherwise noted. Further, for simplicity of explanation, plates 30*a*–30*l* will be described with reference to a generic illustration given in FIG. 4 and referenced as plate 30. In preferred form, and as best seen in FIG. 4, all plates 30 are made of substantially the same stock, particularly, synthetic lumber to avoid deterioration having a composition consisting essentially of a epoxy matrix filled with sawdust and or wood particles; as for example, plastic lumber sold under the trade name TREX available from the Mobil Corporation which is a polyethylene wood polymer composite material. As will be appreciated by those skilled in the art, though plastic lumber is preferred because of its stiffness, required for spreading the sealant on installation, ease of sizing, water-resistance, and anti-corrosive character, other materials having comparable characteristics could also be used. In fact if the application could tolerate future erosion, simple wooden plates could be used, it being understood that if made of wood, in time, the encasing plates themselves would be subject to borer attack.

Continuing with reference to FIG. 4, in preferred form, plates 30 are provided with generally rectangular cross sections, best seen at plate end 32, and feature a generally flat interior surface 34 and exterior surface 36. In preferred form, plates 30 have a nominally 1 by 6 inch cross section, which actually measures approximately ¾ inches by 5 and ¾ inches, and lengths of approximately 10 foot, which lengths are cut as required to fit the structural member to be encased.

As noted above, in order to assure suppression of borer attack, it is essential that the members to be protected be completely and continuously sealed. If the seal is not complete and continuous, water will eventually find its way to the underlying structure, and borer activity will begin again, and be all the more insidious as it will go unnoticed until the structure collapses. While the need for a comprehensive and enduring seal suggests that sealant be spread over the entire area of each exposed member surface, the cost in materials and man power associated with such an approach would be unduly high, and commercially undesirable. In accordance with the present invention, however, it has been found that an economical and cost effective seal can be achieved by judiciously positioning predetermined amounts of sealant at prescribed locations on the plates, and thereafter, uniformly spreading the sealant over sealing zones which extend to the lateral perimeter of the plates by clamping the plates and sealant to the members to be protected; plate-end seals being effected by butting adjoining or corner-arranged plates.

To achieve this, in preferred form plates 30 are provided with epoxy locating furrows 40 and 42 which run axially along the length of plate 30 at interior surface 34, parallel to and spaced by a predetermined amount from the respective plate sides 44 and 46. In accordance with the invention, the spacing of furrows 40, 42 from respective plate sides 44, 46 along the length of plate 30 defines lateral, sealing zones 64, 66 over which sealant will be spread during the assembly to assure sealing of the encased member surface. As will be appreciated, sealing of plate ends in effected by butting successive plates arranged end-to-end, or butting plates arranged at corners.

Also in accordance with the invention, furrows 40 and 42 are dimensioned to define a predetermined load of epoxy sealant 50 that will assure covering of the sealing zones with sealant during assembly. As also will be appreciated, while it is possible to employ plates having flat interior faces 34, establishing the location and the quantity of sealant to be applied becomes uncertain, and subject to inconsistency in the hands of inexperienced workers. However, use of locating furrows 40, 42 properly position and size the amount of sealant to be applied, thereby, enabling quick, consistent and reliable installation of the plates and sealant by even unskilled workers, thus providing an economical and cost effective installation.

Continuing with reference to FIG. 4, plates 30 are also seen to have mounting holes 48 located centrally of the plate width, and extending from exterior surface 36 to interior surface 34. In accordance with the invention, holes 48 are provided to receive corrosive-resistant fasteners; such as stainless steel lag bolts and associated washers 52. In preferred form, for the nominally sized 1 by 6 inch plates 30, holes 48 are sized to receive ⅜ inch diameter by 3 inch long bolts and washers 52, holes 48 being spaced on plates 30 approximately 10 inches between centers.

In accordance with the invention, the sealant is preferably selected to be an epoxy-polyamide mastic containing no lead, asbestos or other toxic materials to avoid environmental contamination or hazard. Still further, the sealant preferably includes no volatile solvents and should be capable of being applied and curing underwater as well as in the air. Such a sealant is commercially available under the product designation, A-788 from KOP-COAT, Inc. of Pittsburgh, Pa. In practice, the two-part system comprising an epoxy and a hardener, may be readily mixed by hand and formed into loads having a radius comparable to that of locating and pre-measuring furrows 40, 42, as best seen in FIG. 4.

In preferred form, the method aspect of the invention includes steps for first measuring the surface of the marine member to be encased; for example, surfaces 54, 56, 58 and 60 of member 22, and, thereafter, sizing plates 30 by cutting one or more lengths to cover the subject surfaces, for example, plates 30*a*–30*l*. Subsequent to sizing plates 30, steps are undertaken to prepare the above-described epoxy-polyamide mastic for application. Specifically, the two-part epoxy system; i.e., epoxy and hardener, are manually mixed and formed into cylindrically-shaped loads 50 having, as noted, a radius comparable to that of locating and pre-measuring furrows 40, 42, as best seen in FIG. 4. As will be appreciated, by forming the epoxy loads into generally-cylindrical shapes to approximate furrows 40 42, the amount of epoxy to be applied is pre-determined; i.e., pre-measured.

Following formation of the epoxy-polyamide sealant into loads 50, the loads are positioned on interior surface 34 of plate 30 at furrows 40 and 42. In accordance with the invention, placement of the epoxy-polyamide at furrows 40, 42 locates the sealant in a predetermined fashion, relative to the plate sides 44, 46, respectively, for subsequent formation of the encasing seal. As will be appreciated, at this stage in the method, plates 30 function not only as a means for measuring out and positioning the sealant, but also, as a pallet for conveniently carrying the sealant to the marine member surfaces to be encased. In this way, the method of the present invention avoids the need for specialty sealant handing or applying tools and procedures, thereby, further simplifying and economizing the installation.

Once a plate 30 is loaded with sealant 50, the combined plate and sealant are positioned at the cap member surface to be encased; as for example, manually. As will be appreciates by those skilled in the art, following manual mixing of the epoxy-polyamide sealant, it exhibits a "tacky" character for a period of time inversely dependent on the amount of sealant, when used in quantities contemplated here; for example, on the order of 40 minutes for a "golf-ball" sized amount, and on the order of 30 minutes for a "softball" sized amount. During this setup period, the tacky sealant will adhere to plate 30 under moderate handling, and the plate-sealant combination can be conveniently moved into position by hand, either above or below the water line, for application to the surface to be encased.

Once in position at pile cap member 22, the plate-sealant combination is manually held in place, and fasteners 52 inserted into plate mounting holes 48. Thereafter, fasteners 52 are screwed into the cap member surface to be encased. As noted, fasteners 52 comprise stainless steel bolts and washers, the bolt, preferably, being self-taping. Also in preferred form, bolt-washer combinations 52, for time-economy reasons, are tightened mechanically; as for example, with a commonly available impact wrench. However, as will be appreciated, a hand wrench sized to the bolt heads also could be used to manually tighten bolt-washer combinations 52.

Figure 7A:
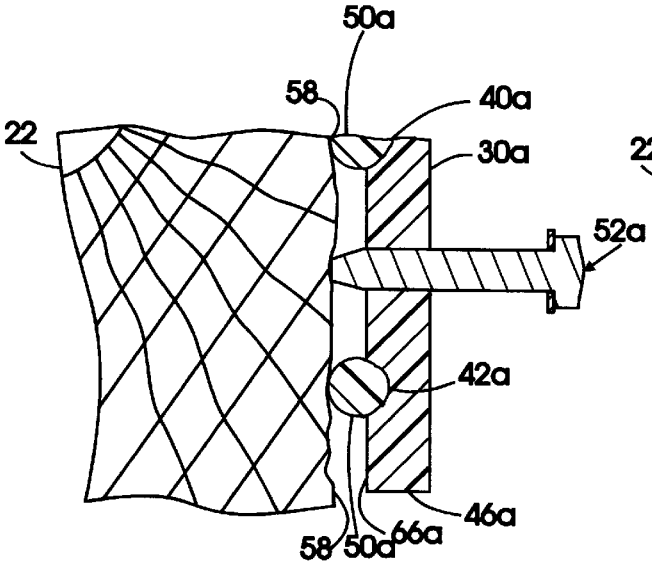
FIG. 7A is a fragmented, cross section taken along line 7—7 of FIG. 6 showing an encasing plate assembly, and cap timber at initial contact in accordance with the invention.

As bolts-washer combinations 52 are run into the cap member surface to be encased, a spreading and clamping process is initiated that forces the epoxy-polyamide sealant out over the interior face 34 of plates 30, on and into the mating portion of the cap member surface being encased. This process of spreading and clamping the epoxy-polyamide mastic to form the seal and encase the mating cap surface is presented graphically in FIGS. 7A to 7C. As shown in FIG. 7A a cross section of a plate 30; for example, 30*a*, is shown spaced from cap member 22, at cap member surface 58 with epoxy-polyamide loads 50*a* making initial contact with surface 58 at the beginning of the spreading and clamping process. In this position, bolt-washer combination 52*a* has just been placed in mounting hole 48*a* and is ready to be driven into cap member 22.

Figure 7B:
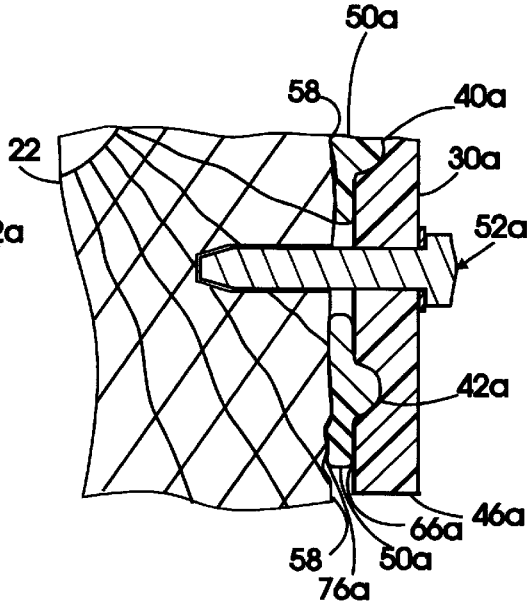
FIG. 7B is a fragmented, cross section taken along line 7—7 of FIG. 6 showing an encasing plate assembly, and cap timber at following initial contact in accordance with the invention.

As seen in FIG. 7B, as bolt-washer combination 52*a* is driven into member 22, plate 30*a* deforms the epoxy-polyamide loads 50*a* and spreads them over and into the member surface 58 being encased. For a more detailed understanding of plate 30*a* and particularly, features of its interior surface, reference may be to the generic description of plates 30*a*–30*l* noted in FIG. 4 as plate 30 and the associated description of FIG. 4 elsewhere in the disclosure.

In the course of this process, not only is the sealant driven into the cap member surface, but also, loose debris and water is driven out of the interface enabling intimate contact of the epoxy-polyamide sealant with cap member surface 58 and interior surface 34*a* of plate 30*a*. Still further, in accordance with the invention, plates 30 are selected to have a sufficient rigidity to assure that adequate force is transmitted from bolt-washer combination 52 to the plate's interior surface 34 to spread sealant loads 50 into the member surface 58 and over sealing zones 64*a*, 66*a*, as bolt-washer combinations 52*a* are driven into cap member 22.

As can also be seen in FIG. 7B and as will be appreciated, as plate and fastener combination spreads the epoxy-polyamide sealant, the sealant is caused to fill in and compensate the irregular contour of the member surface caused by borer erosion shown at region 76*a*.

Figure 7C:
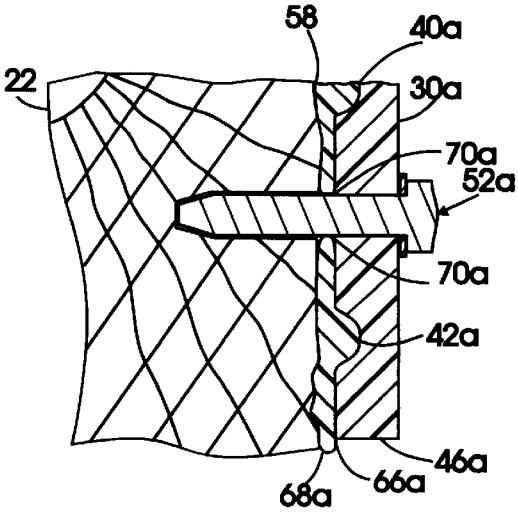
FIG. 7C is a fragmented, cross section taken along line 7—7 of FIG. 6 showing an encasing plate assembly, and cap timber at final contact in accordance with the invention.

Continuing, as bolt-washer combination 52*a* is further run into cap member 22, the spreading action of plate 30*a* and bolt-washer combination 52*a* causes the epoxy-polyamide sealant to be forced outwardly to edges 44*a* and 46*a* respectively of plate 30*a* as best seen in FIG. 7C. In accordance with the invention and as will be appreciated, this action has the effect of assuring that an epoxy-polyamide seal is formed at least over sealing zones 64*a*, 66*a* extending laterally form furrows 40*a*, 42*a* to the respective edges 44*a*, 46*a* of plate 30*a* and down its respective length as best seen in FIG. 7C. However, in accordance with invention, under the action of plate 30*a* and fastener 52*a*, the epoxy-polyamide sealant, in addition to being forced outwardly, is also forced inwardly toward the center of plate 30*a* and may contact the bolt and fill any space between mounting hole 48*a* and the bolt shaft assuring seal off of the cap member surface being encased. As will be appreciated, where furrows 40*a*, 42*a* are located proximate to respective edges 44*a*, 46*a*, and where a lesser amount of sealant is applied; for example where the surface overlaid in less eroded, sealant may not reach the mounting hole 48*a* and fastener 52*a*. Accordingly, in such case, to assure flow of sealant to hole 48*a*, an additional furrow, for the sake of simplicity not shown, may be provided that extends; as for example, orthogonally, between furrows 40*a* and 42*a* which passes over hole 48*a* to receive sealant and assure seal of hole 48*a* and fastener 52*a*. As a yet further alternative, sealant may be inserted at hole 48*a* to assure seal of the hole and fastner. In accordance with the method, the point of importance is that the surface of the marine member being encased be completely sealed, and this would include both the respective outside perimeters of the plates and any apertures provided in the plates.

Continuing with reference to FIG. 7C, as plate 30*a* is installed, each of bolt-washer combinations 52*a* is successively tightened until sealant 50*a* is seen to be squeezed for between plate 30*a* and cap member surface 58 as evidenced by sealant outflow 68*a* at plate sides 44*a* and 46*a* respectively. As will be appreciated, emergence of outflow 68*a* at plate edges 44*a* and 46*a* gives a positive, visual indication to the worker that a continuous seal has been effected between plate 30*a* and cap member surface 58. Further, as is also apparent in FIG. 7C, while sealant is also squeezed inwardly of plate 30*a* as evidence by inflow 70*a*, it remains unseen due to the presence of fastener assembly 52*a*.

Figure 5:
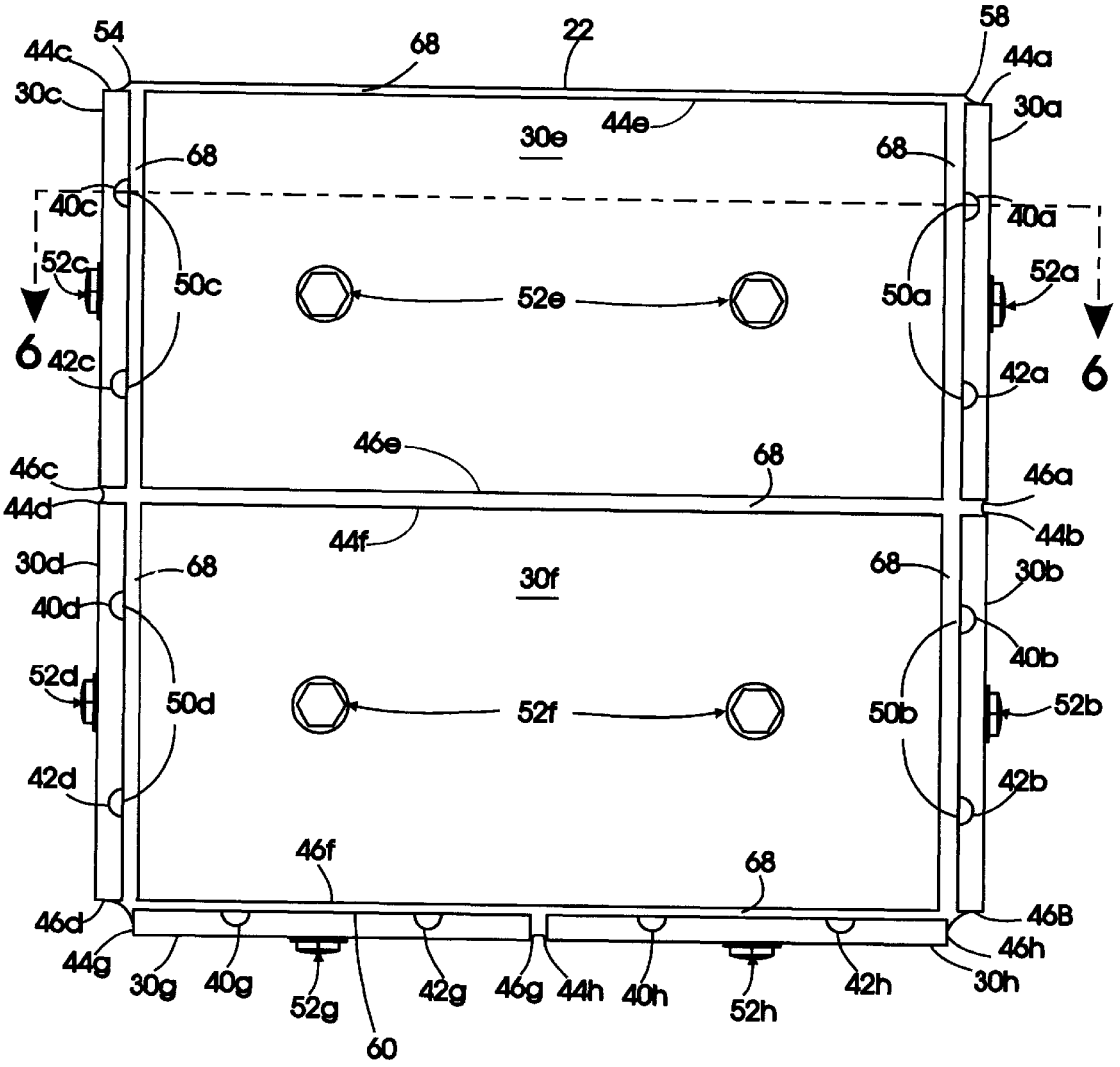
FIG. 5 is an end view of a pile cap timber encased in accordance with the present invention.

Following installation of all of the bolt-washer combinations 52*a* for plate 30*a*, the remaining plates 30*b* to 30*l* are likewise installed to finalize encasement of pile cap member 22. As best seen in the end view of encased cap member 22 presented in FIG. 5, on completion of encasement, plates 30*a*, 30*b*, 30*c*, and 30*d* are clamped to and overlay cap member side faces 58 and 54, respectively; plates 30*e* and 30*f* are clamped to and overlay end face 56 of member 22; and, as also shown, plates 30*g*, 30*h* are clamped to and overlay member 22 bottom surface 60. Still further, though not seen in FIG. 5, in a like manner, plates 30*i*, 30*j* and 30*k*, 30*l* also would be clamped to member 22 at bottom face 60. Additionally, and as is apparent in FIG. 5, sealant outflow 68 at all lateral sides of the respective plates confirms sealing encasement of member 22; end seals, as noted, being effected by butting both adjoining plates and plates arranged at corners; for example, plates 30*a*, 30*c* with plate 30*e* and plates 30*b*, 30*d* with plate 30*f*. As will be appreciated, by virtue of cap member 22 having actual side widths of approximately 11 and ½ inches, two plates 30 having actual widths of approximately 5 and ¾ inches are required to encase member 22.

Figure 6:
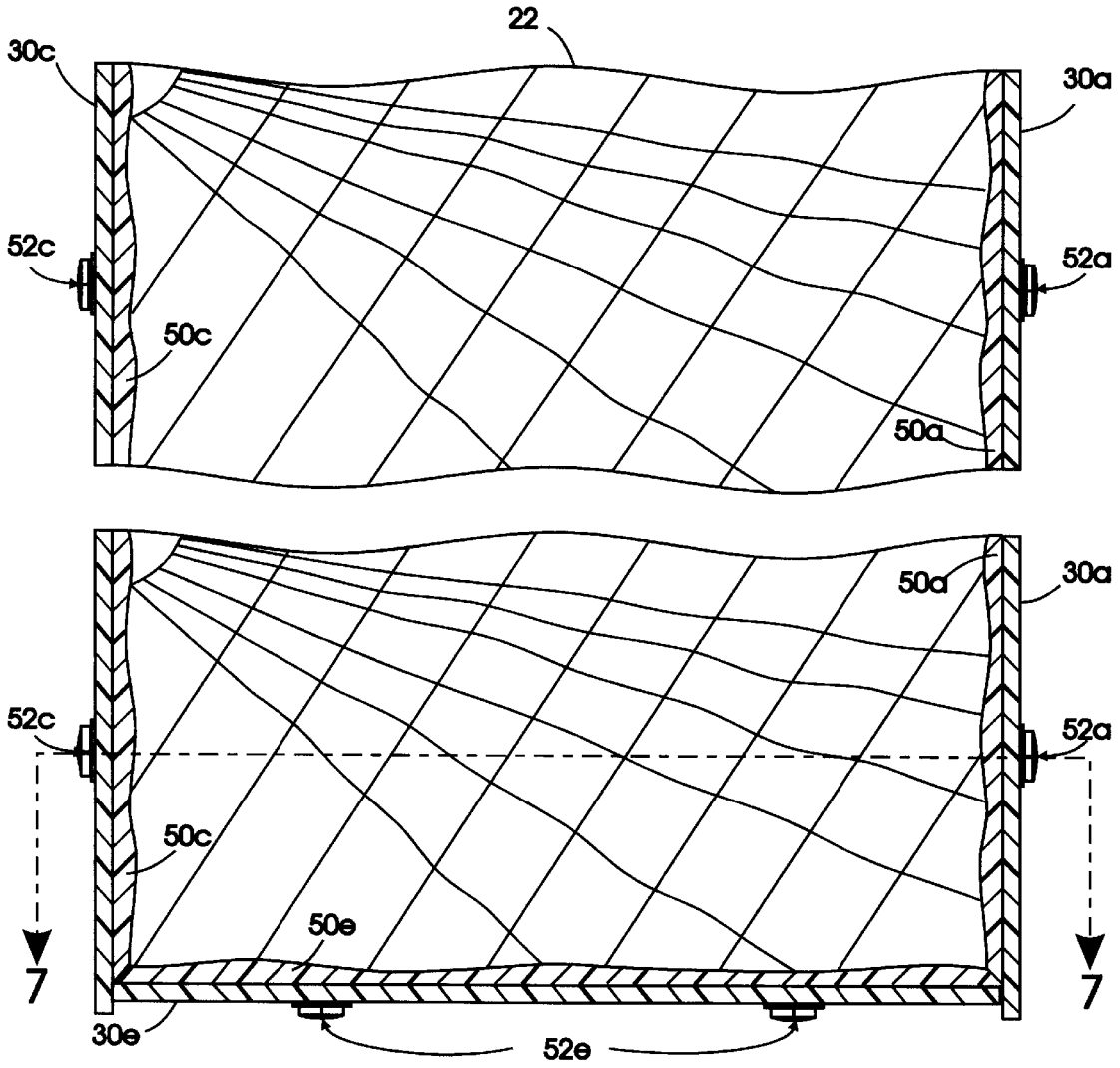
FIG. 6 is a fragmented, cross section taken along line 6—6 of FIG. 5 of an encased pile timber showing the spread of sealant relative to the cap timber and encasing plates in accordance with the present invention.

As pointed out, the spreading and clamping action of plates 30 in combination with the run-up of bolt-washer combinations 52 serve to spread sealant 50 into the eroded and irregular faces of encased member 22 at least over sealing zones 64, 66. The resulting filled in of the eroded faces of member 22 is best seen in FIG. 6, a cross section of the cap member end elevation view presented in FIG. 5, taken through furrows 40*a* and 40*c* of respective plates 30*a*, 30*c* and 30*e*. As seen in FIG. 6, epoxy-polyamide sealant 50*a*, 50*c* and 50*e* from respective plates 30*a*, 30*c*, and 30*e* extends from the respective plates to opposing portion of cap member surfaces. Though not seen in FIG. 6, a similar effect would be produced as a result of the application of plates 30*b*, 30*d* and 30*f* to cap member 22.

In accordance with the invention, and as noted, the primary objective is to establish a complete and enduring seal of the encased marine member to assure borer suffocation and suppression of their attack. In achieving that end, it is a further objective of the invention to produce the desired seal in as economical a manner as possible. Accordingly, the method and resulting structure of the present invention seek to adjust the amount of sealant to the conditions of the member being encased. To the extent borer attack has rendered the member surface more irregular, more epoxy-polyamide mastic would be applied to assure fill-in and seal between the member surface and the encasing plate, at least over the plate sealing zones. Likewise, where the member surface is less irregular, less mastic is required. To accommodate these variations, the size and placement of the loading furrows and companion sealing zone may be adjusted. Also, and as noted additional furrows may be provided at the mounting holes transversely of the lateral furrows to enable seal off of the mounting holes. Further, in preferred form, plates 30 are provided in a multiple categories, each category having a different furrow and sealing zone configurations intended to accommodate a range of sealant load sizes appropriate for different degrees of surface irregularity.

In those cases where a surface of cap member 22 is severely eroded, plate 30 may be modified, as more fully described below, to permit the pumping or injection of larger volumes of sealant into void regions between plates 30 and the surfaces of member 22.

Continuing, in addition to including method steps for suppressing borer attack in pile cap member 22; contributing to its rehabilitation; and producing and improved cap structure, the present invention also includes method steps for suppressing borer attack in pile member 12, whether the member surface is uninterrupted or interrupted, and contributing to its rehabilitation, as well as providing an improved pile structure. As in the case of cap member 22, the present invention accomplishes this by providing steps for encasing the pile member 12 with a plurality of synthetic plates sized to the surfaces to be encased, the plates having a water-resistant sealant distributed at predetermined regions on the plates such that the sealant may be spread over predetermined portions of the structure surface and the plates by clamping the plates and sealant to the pile with corrosive-resistant fasteners.

Figure 8:
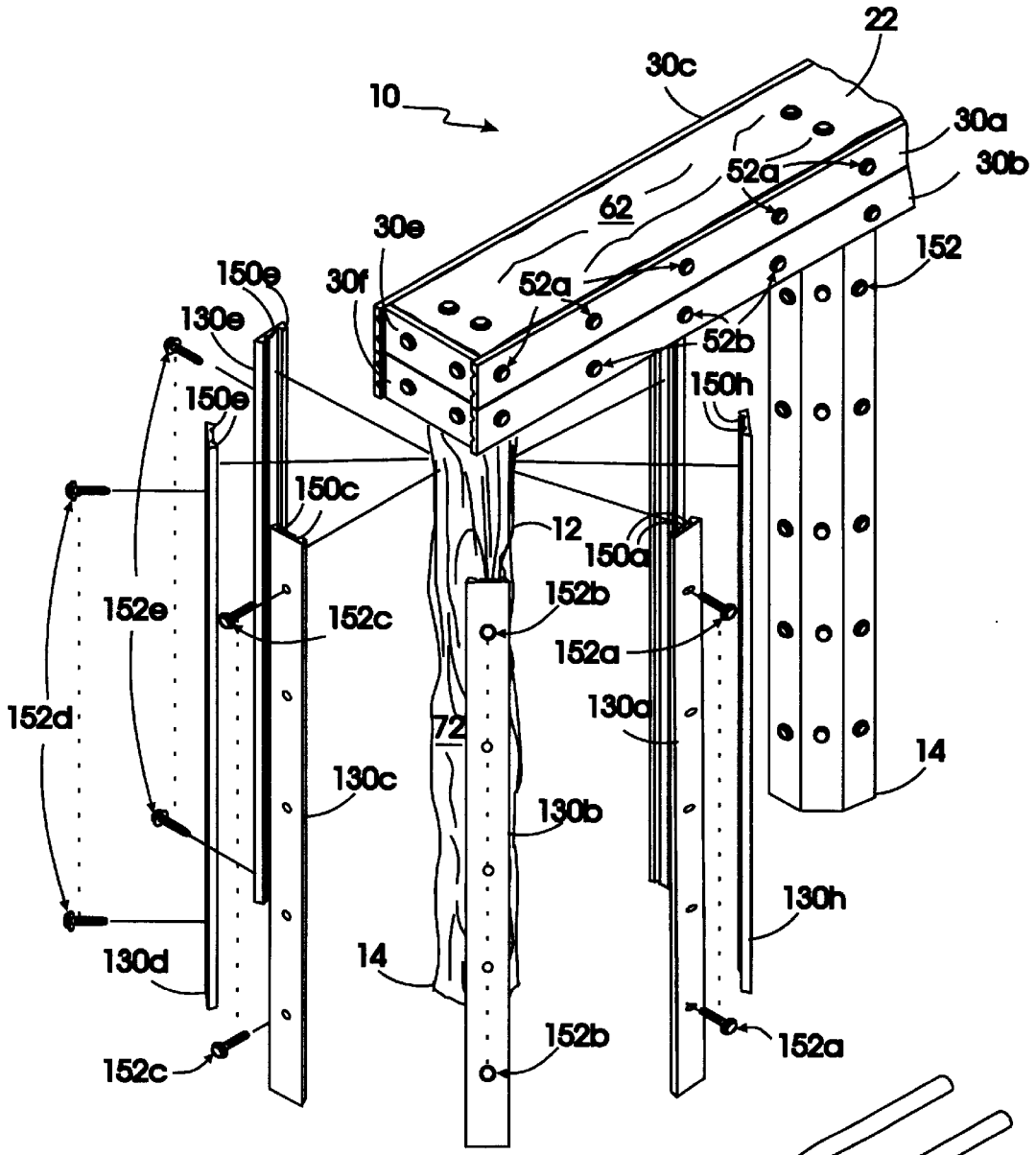
FIG. 8 is an exploded perspective view of a marine pile and cap structure relative to the pile-encapsulating plates, sealant and fasteners of the present invention.

FIG. 8 presents a portion of pier structure 10 with an encased cap member 22 and a pile member 12 shown assembled. Additionally, FIG. 8 also presents another encased pile member 12, which, for purposes of illustration, is shown exploded. As seen there, the method of the present invention includes steps comparable to those for encasing cap member 22, for sizing a series of plates 130*a*–130*h* to the exposed and deteriorated perimeter surface 72 of pile 12, and for, thereafter, anchoring the plates together with a sealant 150 disposed at predetermined portions of the plates to pile member 12 with fasteners 152*a*–152*h*. As in the case of the cap member plates 30*a*–30*l*, in preferred form, and as best seen in FIG. 9, the pile plates 130*a*–130*h* are made of substantially the same stock, particularly, the above-described plastic lumber or its equivalent.

Figure 9:
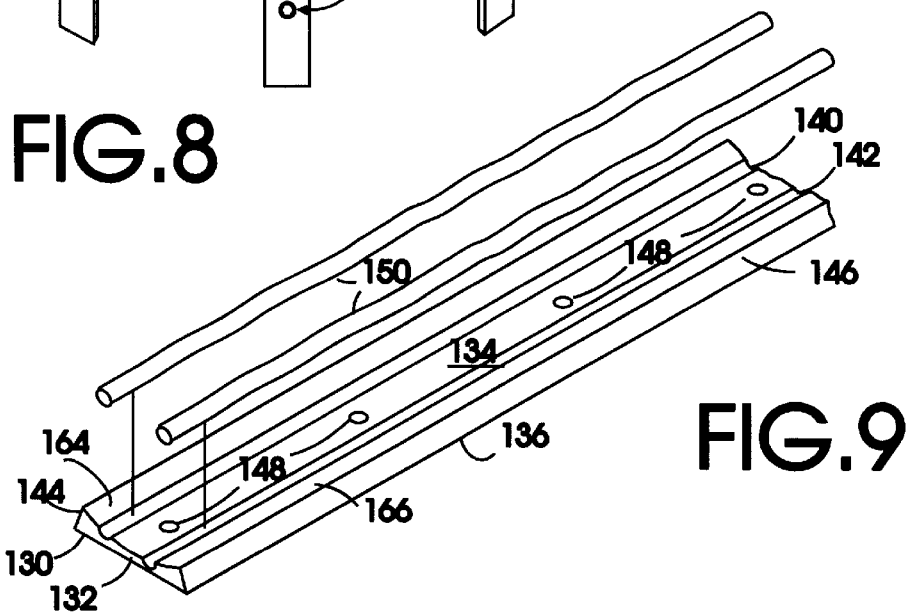
FIG. 9 is a perspective view of the interior face of an encapsulating plate adapted for use on a marine pile, and sealant in accordance with the invention.
Figure 11:
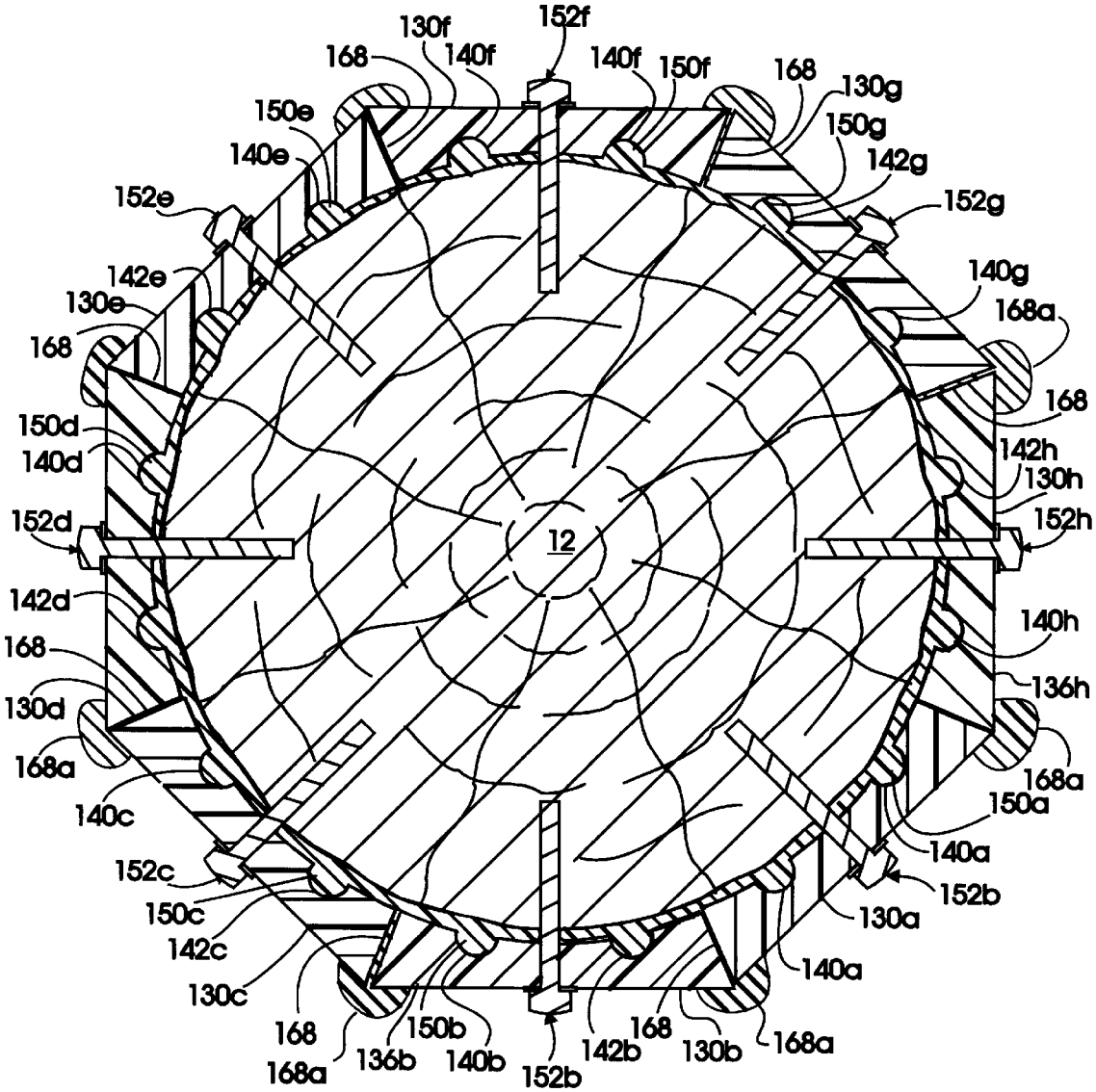
FIG. 11 is a cross section taken along line 11—11 of FIG. 10 of an encased pile showing the spread of sealant relative to the pile and encasing plates in accordance with the present invention.

With reference to FIG. 9, in preferred form, pile plates 130 are generally similar to cap plates 30, however, several important differences are present. In the case of pile plates 130, the plate has a generally trapezoidal cross section, best seen at plate end 132, instead of the generally rectangular cross section of plates 30. In accordance with the invention, the method includes steps for providing plates 130 with trapezoidal profiles so that the plates can be fit around the circumferential, longitudinal perimeter of pile member 12 and sealed as shown in FIG. 11.

In accordance with the invention, each of plates 130*a*–130*h* are substantially the same unless otherwise noted. Further, for simplicity of explanation, plates 130*a*–130*h* will be described with reference to a generic illustration given in FIG. 9 and referenced as plate 130. With reference to FIGS. 9 and 11, while plates 130 can have generally flat interior and exterior surfaces 134 and 136, respectively, in preferred form, interior faces 134 of plates 130 are generally concave and have radiuses of curvature made to approximate the circumference of pile member 12. More specifically, in preferred form and in the case where plates 130 are adapted for use with pile members having nominal 12 inch diameters which actual measure approximately 11.5 inches, plates 130 are dimensioned to have nominal 1 inch thicknesses and nominal 6 inch exterior widths, which actually measures approximately ¾ inches by 5 and ¾ inches; i.e., substantially the stock used for the cap plates 30. However, lateral walls 144 and 146, respectively, of plates 130 are set at approximately 67.5 degrees to exterior face 136 so that eight plates may be positioned circumferentially around pile member 12, extending axially along the pile length as best seen in FIGS. 8 and 11. Yet further, interior surfaces 134 are provided with radiuses of curvature of approximately 5 and ¾ inches. As will be appreciated, the noted dimensioning is suggestive only, and might be adjusted to accommodate piles and plates of different sizes. The point of importance is that plates 130 are sized to fit to pile members 12 to enable sealed encasement of the pile members. As in the case of cap plates 30, plates 130 have lengths of approximately 10 foot, which lengths are cut as required to fit the pile members to be encased.

With reference to FIG. 9, like cap plates 30, pile plates 130 in preferred form are provided with epoxy locating furrows, which in the case of plates 130, are designated 140 and 142, that run axially along the length of plates 30 at interior surfaces 34, parallel to and spaced by a predetermined amount from the respective plate sides 144 and 146. In accordance with the invention, the spacing of furrows 140, 142 from respective plate sides 144, 146 along the length of plates 130 defines lateral, sealing zones 164, 166 over which sealant will be spread during the assembly to assure sealing of the encased member surface. As will be appreciated, sealing of plate ends is effected by butting successive plates arranged end-to-end, or butting plates arranged laterally. Again, as in the case of cap plates 30, pile plates 130 depending on the amount of sealant required, may include additional furrows, not shown extending, for example, orthogonally between lateral furrows 140, 142 which run through mounting holes 148.

As in the case of cap plates 30, furrows 140 and 142 of pile plates 130 are dimensioned to define a predetermined load of epoxy sealant 150 that will assure covering of the sealing zones during assembly. And, as in the case of cap plates, while it is possible to employ plates having non-sculptured faces 134, establishing the location and the quantity of sealant to be applied becomes uncertain, and subject to inconsistency, particulary in the hands of inexperienced workers. Use of locating furrows 140, 142, on the other hand, properly position and sizes and amounts of sealant to be applied, thereby, enabling quick, consistent and reliable installation of the plates and sealant by even unskilled workers, thus providing an economical and cost effective installation. Still further, with respect to pile plates 130, additional amounts of sealant 130 are provided at furrows 140, 142 to assure spread of sealant 150 into the space between adjoining plate side walls 146, 144. As will also be appreciated, as an alternative to providing additional amounts of sealant at furrows 140, 142, sealant loads may also be applied at the exterior side walls 144, 146 of pile caps 130 to further assure sealing encasement of pile member 12.

Continuing with reference to FIG. 9, like cap plates 30, pile plates 130 are also seen to have mounting holes 148 located centrally of the plate width, and extending from exterior surface 136 to interior surface 134. In accordance with the invention, holes 148 are provided to receive corrosive-resistant fasteners; such as stainless steel lag bolts and associated washers 152. As in the case of cap plates 30, in preferred form, for nominally sized 1 by 6 inch plates 130, holes 148 are sized to receive ⅜ inch diameter by 3 inch long bolts and washers 152, holes 148 being spaced on plates 30 approximately 10 inches between centers.

As in the case of cap plates 30, in preferred form, the method aspect of the invention includes steps for first measuring the length of the pile member to be encased and, thereafter, sizing plates 130 by cutting the lengths to cover the subject surfaces, for example, plates 130*a*–130*h* shown in FIG. 8. For the case illustrated, only a single length of plating is applied per radial subdivision of the pile perimeter, the pile length being considered to be less than or equal to the plating standard length of 10 feet. If the pile were longer that 10 feet, additional lengths of plating, or portions thereof, would be applied in butted relation as required. Following pile plate sizing, the same above-described, epoxy-polyamide mastic as used for the cap plating is prepared for use with the pile plating.

For a more detailed understanding of plate 130*a* and particularly, features of its interior surface, reference may be to the generic description of plates 130*a*–130*h* noted in FIG. 9 as plate 130 and the associated description of FIG. 9 elsewhere in the disclosure. In case of pile plate 130*a*, following formation of the sealant into loads 150*a*, the loads are positioned on interior surface 134*a* of plate 130*a* at furrows 140*a* and 142*a*, and optionally at plate side walls 144*a*, 146*a*. Once a plate 130*a* is loaded with sealant 150*a*, the combined plate and sealant are positioned at pile member surface 72 as best seen in FIG. 8. Once in position at pile member 12, the plate-sealant combination is manually held in place, and a fastener 152*a* inserted into a plate mounting hole 148. Thereafter, fastener 152*a* is screwed into the surface 72 of the pile 12 to be encased. As noted, fasteners 152 comprise stainless steel bolts and washers, the bolt, preferably, being self-taping, the bolt-washer combinations 152, preferably being tightened mechanically; as for example, with a commonly available impact wrench. As will be appreciated, a hand wrench sized to the bolt heads also could be used.

As bolts-washer combinations 152*a* are run into pile member surface 72, the spreading and clamping process described in connection with installation of the cap plates is initiated which forces the epoxy-polyamide sealant out over the interior surface 134*a* of plates 130*a*, on and into the mating portion of pile member surface 72 being encased and over plate side walls 144*a*, 146*a* as best seen in FIG. 11.

Again, as in the case of cap plates 30, upon driving the bolt-washer combinations 152*a*, into pile member 12, plate 130*a* deforms the sealant loads 150*a* and spread the sealant over and into the pile surface 72. In the course of this process, not only is the sealant driven into the pile surface, but also, loose debris and water is driven out of the interface, enabling intimate contact of the pile member surface 72 and interior surface 134*a* of plate 130*a*. Still further, and as with cap plates 30, pile plate 130*a* is selected to have sufficient rigidity to assure that adequate force is transmitted from bolt-washer combinations 152*a* to the plate's interior surface 134*a* to spread sealant loads 150*a* into pile member surface 72 and over sealing zones 164*a*, 166*a*, as bolt-washer combination 152*a* is driven into pile member 12. And, as noted in connection with cap plates 30, as plate 130*a* and fastener combination 152*a* spread sealant 150*a*, the sealant is caused to fill in and compensate the irregular surface of pile member 12.

Continuing, as bolt-washer combination 152*a* is further run into pile member 12, the spreading action of plate 130*a* and bolt-washer combination 152*a* causes the sealant to be forced outwardly to edges 144*a* and 146*a*, respectively of plate 130*a*. As in the case of the cap plates 30, this action has the effect of assuring that a seal is formed at least over sealing zones 164*a*, 166*a*. In accordance with invention, under the action of plate 130*a* and fastener 152*a*, in addition to sealant being forced outwardly, it is also forced inwardly toward the center of plate 130*a* and may contact the bolt and fill any space between mounting hole 148*a* and the bolt shaft assuring seal off of the cap member surface being encased. Once again, in the case where placement of furrows 140*a*, 142*a* and the amount of sealant to be applied does not assure seal of hole 148*a* and fastener 152*a*, additional furrows may be provided orthogonally of lateral furrows 140*a*, 142*a* through holes 148*a*. In the alternative, sealant may be provided at holes 148*a* and fastener 152*a*.

As plate 130*a* is installed, each of bolt-washer combinations 152*a* is successively tightened until sealant 150*a* is seen to be squeezed for between plate 130*a* and pile member surface 72 as evidenced by sealant outflow 168*a* at plate sides 144*a* and 146*a* respectively. Further, while sealant is also squeezed inwardly of plate 130*a*, it remains unseen due to the presence of fastener assembly 152*a*. Following installation of all of the bolt-washer combinations 152*a* for plate 130*a*, the remaining plates 130*b* to 130*h* are likewise installed to finalize encasement of pile member 12.

In accordance with the invention, where surface 72 of pile 12 is severely eroded and accordingly, severely irregular, sealant 150 may not completely fill in all the surface. In such case, epoxy may be applied in volume to pile 12 just prior to applying plates 130. In the alternative, following installation of plates 130 to encase pile member 12, plates 130 may be provided with conduits that extend from exterior surface 136 to interior surface 134; as for example, by drilling holes in plates faces 136, and a suitable filling; such as, epoxy, mud, cement etc., pumped or otherwise injected into the spaces between the interior faces 134 of plates 130 and surface 72. In this regard, appropriate notation may be made on exterior face 136 of plates 130 indicating the need for filling as the condition of pile surface 72 is evaluated when plates 130 are installed. In the alternative, plates 130 may be provided with conduits along its length prior to installation. The conduits can be provided either as apertures pre-formed in the plates at fixed length along plate face 146, or as drilled holes mapped to face 136 base on examination of pile surface 72. As will be appreciated, this same approach could also be used in connection with installation of cap encasing plates 30.

Figure 10:
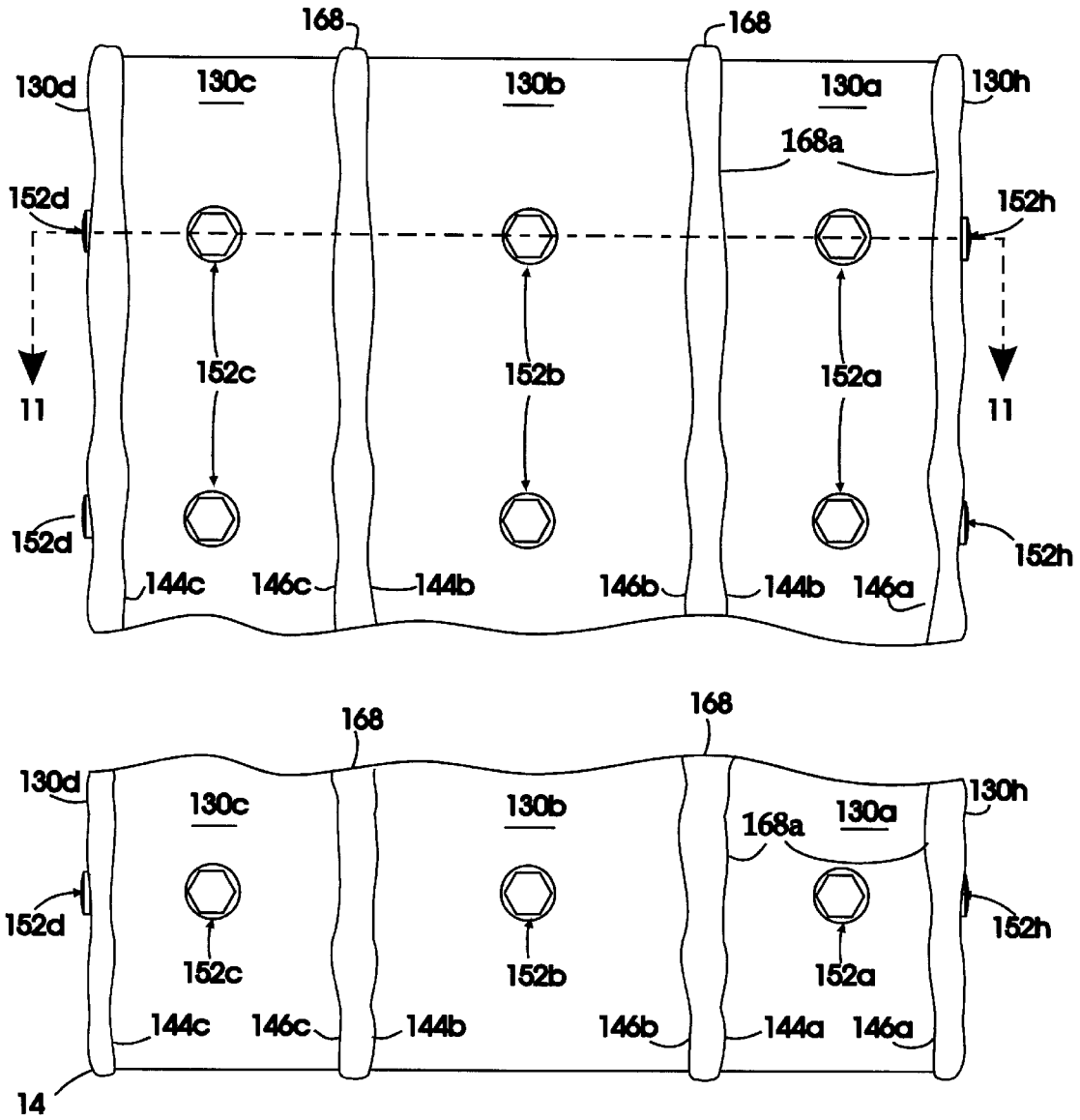
FIG. 10 is an elevation view of a marine pile encased in accordance with the present invention.

As best seen in the elevation view of encased pile member 12 presented in FIG. 10, on completion of encasement, plates 130*a*,–130*h*, are clamped to and overlay pile member side faces 72. And, as is apparent in FIG. 10, sealant outflow 168 at all lateral sides of the respective plates confirms sealing encasement of pile member 12.

Continuing, as pointed out, the spreading and clamping action of plates 130 in combination with the run-up of bolt-washer combinations 152 serve to spread sealant 150 into the eroded and irregular faces of encased pile member 12 and between side faces 144, 146 of plates 130. The resulting fill in of the eroded faces of member 22 and between plates 130 is best seen in FIG. 11, a cross section of the pile member end elevation view presented in FIG. 10, taken through fasteners 152. As seen in FIG. 11, epoxy-polyamide sealant 150*a*, to 150*h* from respective plates 130*a*, to 130*h*, extends from the respective plates to opposing portion of the pile member surface. Again, as noted above, in the case where pile surface 72 is severely eroded, voids may exist between plate interior surfaces 134 and pile surface 72, seal between plates being assured by application of sealant directly to walls 144, 146. As noted above, where voids are likely, in accordance with the invention, either additional sealant may be applied to the pile or plate during assembly, or in the alternative, following assembly of plates 130 to pile member 12, a filler such as epoxy, mud, cement, etc. may be pumped or injected into any voids between interior faces 134 of plates 130 and pile surface 72 through conduits that extend from the outer surfaces 136 to the inner surface of plates 130. This procedure is particularly desirable where rehabilitation of the pile structure is sought.

However, in the alternative, where suppression of borer activity and economy are of primary concern, and structure rehabilitation of secondary concern, care need only be taken to assure that sealing encasement of pile 12 at the perimeter of plates 130 is effected to make certain that pile 12 will be made water tight and borers will be suffocated.

From the above, it is apparent that application of the method of the present invention leads to an improved marine structure that is capable of withstanding borer attack. Particularly, and with reference to FIGS. 5, 6 and 8, 10, 11, in its article aspect, the invention features an improved borer-immune marine structure having a plurality of rigid, pre-sized synthetic encasing plates 30, 130 preferably made of synthetic material such as plastic lumber or the like, located at various members 22, 12 of the underlying marine structure, the plates 30, 130 being sealed and held to the surface of an underlying structure. In accordance with the invention, the encasing plates may be at least initially held to the underlying structural elements 30, 130 with a marine sealant 50, 150 and corrosive-resistant fasteners 52, 152, fasteners 52, 152 being subject to removal upon completion of the improved structure.

In preferred form, the improved structure includes the placement of predetermined amounts of marine sealant 50, 150, spread at predetermined locations between the encasing plates and marine structure element surface. Still further, in preferred form, the encasing plates 30, 130 include means in the form of patterned depressions for receiving, pre-measuring and positioning the marine epoxy to be applied at the predetermined locations on the plate faces that mates with the wooden structure to be encased.

Figure 12:
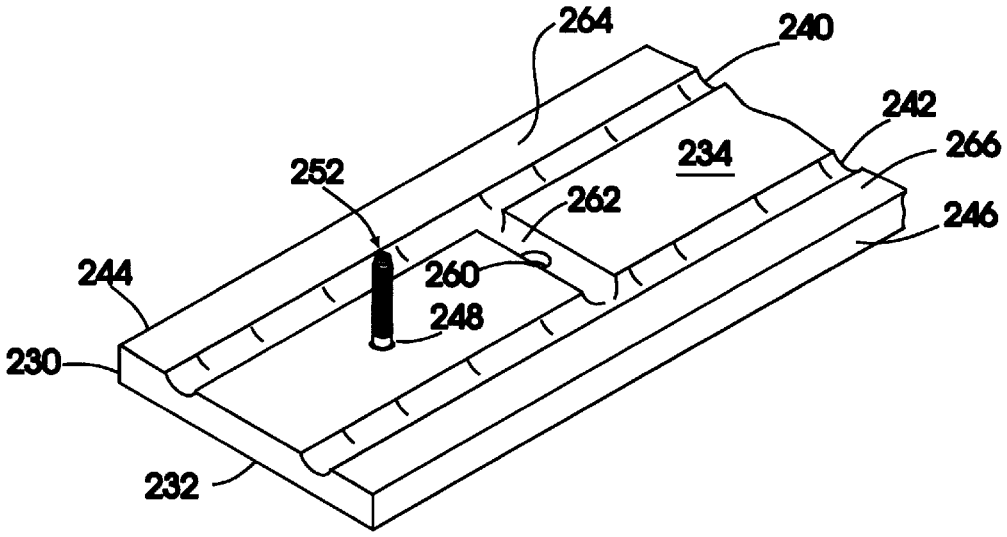
FIG. 12 is a perspective plan view of the interior face of a second form of the encasing plate which has been adapted to receive sealant by injection in accordance with the invention.
Figure 13:
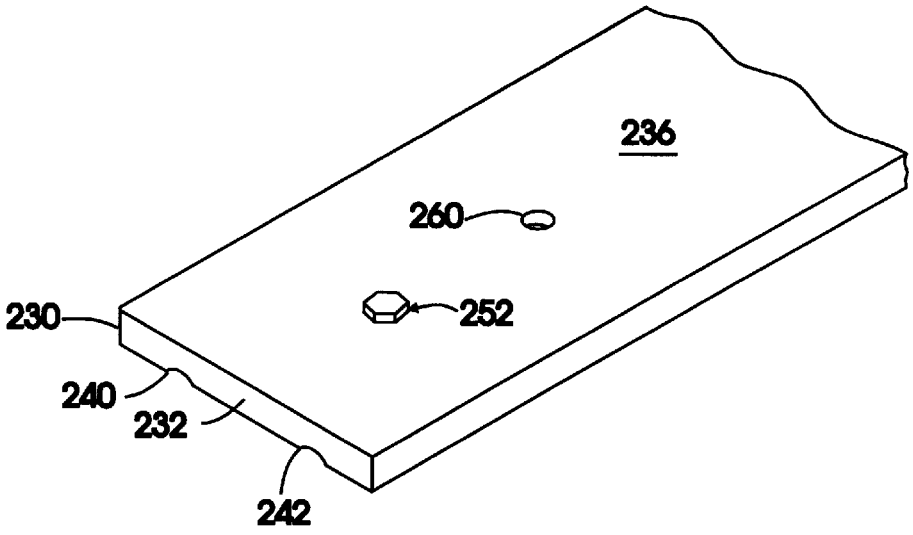
FIG. 13 is a perspective plan view of the exterior face of a second form of the encasing plate which has been adapted to receive sealant by injection in accordance with the invention.

Yet further in preferred form, the structure optionally includes filler in the form of epoxy, mud, cement and the like, which has been places between the encasing plates and the marine structure in regions of sever erosion. In that regard, FIG. 12, and 13 illustrate a further form of plate 30 used for encasing cap members 22, the further form of the encasing plate being designated 230 and being adapted for use in injecting or pumping filler between the plate and the marine member being encased. As seen in FIG. 12, plate 230 is again preferably made of synthetic material such as plastic lumber or the like above described and features a generally rectangular cross section best seen at end 232. Additionally, plate 230 includes a generally flat interior surface 234 and exterior surface 236 and yet further, are provided with epoxy locating furrows 240 and 242 which run axially along the length of plate 230 at interior surface 234, parallel to and spaced by a predetermined amount from the respective plate sides 244 and 246. As in the case of plate 30, furrows 240, 242 of plate 230 are spaced from respective plate sides 244, 246 along the length of plate 230 to define lateral, sealing zones 264, 266 over which sealant will be spread during the assembly to assure sealing of the encased member surface. Once again, if required, additional furrows my be provided, preferably orthogonally, between furrows 240, 242 at mounting holes 248 where because of placement of furrows 240, 242 proximate respective plate sides 244, 246, spread of sealant to mounting holes 248 is not assured. As will be appreciated, sealing of plate ends in effected by butting successive plates arranged end-to-end, or butting plates arranged at corners.

Additionally, plates 230 are also seen to include mounting holes 248 located centrally of the plate width, and extending from exterior surface 236 to interior surface 234 in which a fastener 252 is located. Still further, plate 230 is provided with a feed aperture 260 and a distribution conduit 262 for enabling pumping or injecting of sealant and or fill between plate 230 and the marine member to be encased.

In practice of the encasement method in accordance with the invention for the alternate plate form 230, once the marine member to be encased is measured, plate 230 is sized and immediately located at the member to be encased, without mounting of sealant as undertaken in connection with use of plate 30. Thereafter, fasteners 232 is be run into the member to be encased to a point where plate 230 is drawn proximate to the member so as to make loose contact with the member surface. Subsequently, epoxy sealant is pumped or injected into feed aperture 260 and distributed through conduit 262 between plate 230 and the member being encased, until sealant is seen to begin to emerge form the lateral sides 244 and 246 of plate 230. Thereafter, fastener 252 would be tightened down to insure spread out and clamping of the sealant and the seal off of the member encased. As will be appreciated, use of plate 230 and supply of sealant through fee aperture 260 and conduit 262 assures a sufficient supply of sealant at furrows 240, 242 in the presence of severely eroded surfaces to enable seal at least at the perimeter of plate 230.

Continuing, as will also be appreciated, plate 230 may be readily adapted for use as a pile encasing plate by simple modifying side walls 244, 246 of plate 230 to be trapezoidal as described above in connection with plate 130, and, in preferred form, additionally modifying plate interior face 234 to be concave in order to approximate the circumference of the pile encased.

While this invention has been described in its preferred form, it will be appreciated that changes may be made in the form, construction, procedure and arrangement of its various elements, and steps without departing from its spirit or scope.

What I claim is:

1. A method for suppressing erosion of a marine structure, the structure having one or more surfaces at which erosion may occur, the method including the steps of:

a. providing a plurality of plates for covering at least a portion of the cross sectional perimeters of the surfaces of the marine structure subject to erosion;

b. providing a sealant at predetermined regions of the respective plates;

c. positioning the respective plates and sealant at the structure surfaces subject to erosion so as to cover at least a portion of the cross sectional perimeters of the surfaces subject to erosion; and d. spreading the sealant over predetermined portions of the structure surfaces subject to erosion and the respective plates by clamping the respective plates and sealant to at least a portion of the cross sectional perimeters of the structure surfaces subject to erosion, wherein clamping the respective plates and sealant to the structure subject to erosion includes providing one or more fasteners that extend from the respective plates into the structure subject to erosion and variably tightening the fasteners to controllably spread the sealant.

2. The method of claim 1 wherein erosion of the structure arises from marine borer attack and wherein providing the sealant includes providing a water-resistant, epoxy-based sealant.

3. The method of claim 2 wherein the respective encasing plates include an interior face which overlays the structure surface subject to erosion, and providing the epoxy-based sealant includes locating the sealant at predetermined regions on the interior faces of the respective encasing plates.

4. The method of claim 3 wherein providing the encasing plates includes providing the respective encasing plates with sealant positioning means at predetermined regions on the respective interior faces of the respective encasing plates.

5. The method of claim 4 wherein providing the sealant includes forming the sealant positioning means as sealant receiving means that facilitates determination of the amount of sealant to be applied to the respective plates.

6. The method of claim 5 wherein providing the sealant includes forming the sealant receiving means as furrows at predetermined locations on the interior face of the respective encasing plates.

7. The method of claim 6 wherein spreading the sealant includes providing the fasteners as threaded elements that may be screwed into the respective structure surfaces subject to erosion to draw the respective plates against the structure surfaces, the respective plates further being provided with predetermined sealing regions at the interior surfaces of the respective plates, such that the respective plates spread the sealant into the structure surfaces and the predetermined sealing regions as the respective fasteners are threaded into the structure, and wherein providing the respective plates includes providing the respective plates made from a synthetic material.

8. The method of claim 7 wherein providing the respective plates includes providing the respective plates with a substantially flat interior surface when the structure surface to be overlaid is generally planar, and providing the encasing plates with a concave interior surface when the structure surface to be overlaid is circumferential.

9. A method for suppressing erosion of a marine structure, the structure having one or more surfaces at which erosion may occur, the method including the steps of:

a. providing one or more encasing plates made of synthetic material for covering the surfaces of the marine structure subject to erosion;

b. providing a water-based, epoxy sealant at predetermined regions of the respective plates;

c. positioning the respective plates and sealant at the structure surfaces subject to erosion; and d. spreading the sealant over predetermined portions of the structure surfaces subject to erosion and the respective plates by clamping the respective plates and sealant to the structure surfaces subject to erosion, wherein clamping the respective plates and sealant to the structure includes providing one or more threaded-element fasteners that extends from the respective plates and may be screwed into the structure, the respective plates, respectively, having interior surfaces which overlay the structure surfaces subject to erosion, the respective plates having predetermined sealing regions at the interior surfaces such that the respective plates spread the sealant into the overlaid structure surfaces and the respective sealing regions as the respective fasteners are screwed into the structure, the interior surfaces of the respective plates additionally including sealant positioning furrows at predetermined locations on the interior surfaces, the furrows for determining the amount of sealant to be applied to the respective plates, and wherein, the respective plates have substantially flat interior surfaces when the subject surfaces to be overlaid are generally planar, and concave interior surfaces when the subject surface to be overlaid are circumferential, and wherein providing the encasing plates includes providing the respective plates with a rectangular cross section when the structure surfaces to be overlaid are generally planar, and providing the encasing plates with a trapezoidal cross section when the structure surfaces to be overlaid are circumferential.

10. A method for suppressing erosion of a marine structure, the structure having one or more surfaces at which erosion may occur, the method including the steps of:

a. providing encasing means for covering the surface of the marine structure subject to erosion;

b. providing a sealant at predetermined regions of the encasing means;

c. positioning the encasing means and sealant at the structure surfaces subject to erosion; and d. spreading the sealant over predetermined portions of the structure surfaces subject to erosion and the encasing means by clamping the encasing means and sealant to the structure surface to erosion; and wherein positioning the encasing means and sealant at the structure surfaces subject to erosion includes forming voids between the encasing means and the structure surfaces subject to erosion, and wherein the method further includes injecting filler into the voids.

11. The method of claim 10, wherein providing the encasing means includes forming the encasing means as one or more plates having an interior surface and an exterior surface, and wherein injecting the filler into the voids between the respective plates and the structure surfaces subject to erosion includes providing apertures that extend from the respective exterior surface of the respective plates to the interior surface of the respective plates and injecting filler through the apertures.

12. A method for suppressing erosion of a marine structure, the structure having one or more surfaces at which erosion may occur, the method including the steps of:

a. providing a plurality of plates, respectively, having exterior surfaces and interior surfaces, for covering at least a portion of the cross sectional perimeters of the surfaces of the marine structure subject to erosion;

b. injecting sealant between the interior surface of the respective plates and the structure surface subject to erosion; and c. positioning the respective plates with the interior surfaces overlaying at least a portion of the cross sectional perimeters of the structure surfaces subject to erosion and attaching the respective plates to at least a portion of the cross sectional perimeters of the surfaces subject to erosion by clamping; wherein clamping the respective plates and sealant to the structure subject to erosion includes providing one or more fasteners that extend from the respective plates into the structure subject to erosion and variably tightening the fasteners to controllably spread the sealant.

13. A method for suppressing erosion of a marine structure, the structure having one or more surfaces at which erosion may occur, the method including the steps of:

a. providing encasing means having an exterior surface and an interior surface for covering the surfaces of the marine structure subject to erosion;

b. positioning the encasing means with the interior surface overlaying the structure surfaces subject to erosion and attaching the encasing means to the structure surface by clamping; and c. injecting sealant between the interior surface of the encasing means and the structure surface subject to erosion and, further including spreading the sealant over predetermined portions of the structure surfaces subject to erosion and the encasing means by clamping the encasing means and sealant to the structure surface subject to erosion.

14. The method of claim 13, wherein injecting sealant between the encasing means and the structure surface subject to erosion includes providing apertures that extend from the exterior surfaces of the respective plates to interior surfaces of the respective plates and injecting filler through the apertures.

15. A wooden marine structure resistant to erosion, the structure comprising:

a. an underlying wooden marine structure having one or more surfaces subject to erosion;

b. a plurality of encasing plates, the respective plates having interior surfaces, exterior surfaces and lateral borders, the interior surfaces of the respective plates overlaying at least a portion of the cross sectional perimeters of the structure surfaces subject to erosion;

c. clamping means for clamping the respective plates to the surfaces of the underlying structure; the clamping means including one or more fasteners that extend from the respective plates into the structure subject to erosion;

d. one or more reservoirs of sealant positioned at predetermined location on the interior surfaces of the respective plates; and e. sealant variably spread from the reservoirs to predetermined locations proximate the plate borders by the clamping means, the spread sealant lying variably between the respective encasing plates and at least a portion of the cross sectional perimeters of the structure surfaces.

16. The structure of claim 15 wherein the respective encasing plates further include means in the form of patterned depressions for receiving and pre-measuring the sealant applied at the predetermined locations on respective plate faces that overlay with the structure surface subject to erosion.

17. A wooden marine structure resistant to erosion, the structure comprising:

a. an underlying wooden marine structure having one or more surfaces subject to erosion;

b. a plurality of encasing plates, the respective plates having interior surfaces, exterior surfaces and lateral borders the interior surfaces of the respective plates overlying the structure surfaces subject to erosion;

c. clamping means for clamping the encasing plates to the surfaces of the underlying structure;

d. one or more reservoirs of sealant positioned at predetermined location on the interior surfaces of the respective plates; and e. sealant spread from the reservoirs to predetermined locations proximate the plate borders by the clamping means, the spread sealant lying between the respective encasing plates and structure surfaces, wherein the clamping means includes one or more threaded fasteners that extends from the respective plates into the respective overlaid structure surfaces subject to erosion, and wherein the respective encasing plates have a substantially flat interior surface when the overlaid structure surface is generally planar, and a concave interior surface when the structure overlaid surface is circumferential; and wherein the encasing plates have a rectangular cross section when the overlaid structure surface is generally planar, and have with a trapezoidal cross section when the overlaid structure surface is circumferential.

18. The structure of claim 17, wherein the encasing plates include apertures extending from the interior surface of the encasing plates to the exterior surface of the encasing plates arranged to enable a filler to be injected into voids arising between the respective encasing plates and structure surface subject to erosion.

* * * * *